US012752959B2

(12) United States Patent
Hatcher

(10) Patent No.: US 12,752,959 B2
(45) Date of Patent: Oct. 6, 2026

(54) PACKAGING FOR AN AEROSOL DELIVERY DEVICE AND CONSUMABLE COMPONENTS

(71) Applicant: R. J. Reynolds Tobacco Co., Winston-Salem, NC (US)

(72) Inventor: Mark Shane Hatcher, Pfafftown, NC (US)

(73) Assignee: R. J. Reynolds Tobacco Co., Winston-Salem, NC (US)

( * ) Notice: Subject to any disclaimer, the term of this patent is extended or adjusted under 35 U.S.C. 154(b) by 25 days.

(21) Appl. No.: 18/906,942

(22) Filed: Oct. 4, 2024

(65) Prior Publication Data

US 2025/0026529 A1 Jan. 23, 2025

Related U.S. Application Data

(62) Division of application No. 17/650,977, filed on Feb. 14, 2022, now Pat. No. 12,139,312.

(60) Provisional application No. 63/150,355, filed on Feb. 17, 2021.

(51) Int. Cl.

| | |
|---|---|
| ***B65D 5/50*** | (2006.01) |
| ***B65D 5/02*** | (2006.01) |
| ***B65D 85/20*** | (2006.01) |

(52) U.S. Cl.

CPC ..... *B65D 5/5059* (2013.01); *B65D 5/0227* (2013.01); *B65D 85/20* (2013.01); *B65D 2203/06* (2013.01); *B65D 2301/20* (2013.01)

(58) Field of Classification Search

CPC .... B65D 5/5059; B65D 5/0227; B65D 85/20; B65D 2203/06; B65D 2301/20; B65D 5/504; B65D 5/0254

See application file for complete search history.

(56) References Cited

U.S. PATENT DOCUMENTS

| | | | | |
|---|---|---|---|---|
| 1,021,998 A | | 4/1912 | Myers | |
| 2,176,274 A | | 10/1939 | Parnin | |
| 3,682,597 A | | 8/1972 | Husch | |
| 3,684,084 A | * | 8/1972 | Kanzelberger | B65D 5/4204 229/131.1 |
| 4,434,890 A | | 3/1984 | Sieck et al. | |
| 4,903,892 A | * | 2/1990 | McNair | B65D 5/5002 206/422 |
| 5,005,701 A | * | 4/1991 | Dutcher | B65D 5/5019 229/162.1 |
| 5,057,282 A | | 10/1991 | Linder | |
| 5,135,158 A | * | 8/1992 | Boyle | B65D 5/701 229/102 |
| 5,839,649 A | * | 11/1998 | Clark | B65D 5/5016 229/114 |

(Continued)

*Primary Examiner* — Orlando E Aviles
*Assistant Examiner* — Jenine Spicer
(74) *Attorney, Agent, or Firm* — Womble Bond Dickinson (US) LLP; Chris Humphrey; John V. Forcier

(57) ABSTRACT

The present disclosure is directed to various packaging devices or arrangements and the blanks configured to form the inner and outer packages that make up the devices. The blanks typically include a plurality of panels that are folded and bonded together to define a compartment when formed into a package. The compartment may be employed to store a consumable product, such as cartridges for an aerosol delivery device. Related methods for forming the blanks into the packages are also provided.

14 Claims, 30 Drawing Sheets

(56) References Cited

U.S. PATENT DOCUMENTS

| | | | | |
|---|---|---|---|---|
| 5,871,145 | A | 2/1999 | Hermann et al. | |
| 6,012,630 | A * | 1/2000 | Block | B65D 5/48004 206/192 |
| 6,871,778 | B2 * | 3/2005 | Petrelli | B65D 5/725 229/122 |
| 8,091,705 | B1 | 1/2012 | McCutchen | |
| 8,499,999 | B2 * | 8/2013 | Sieber | B65D 5/4204 229/162.1 |
| 2007/0261990 | A1 | 11/2007 | Weston et al. | |
| 2014/0312109 | A1 | 10/2014 | Weston | |

* cited by examiner

PACKAGING FOR AN AEROSOL DELIVERY DEVICE AND CONSUMABLE COMPONENTS

CROSS-REFERENCE TO RELATED APPLICATIONS

This application claims priority to U.S. patent application Ser. No. 17/650,977; filed Feb. 14, 2022, and claims priority and the benefit of U.S. Provisional Patent Application No. 63/150,355; filed Feb. 17, 2021, the disclosures of which are hereby incorporated by reference in their entirety.

TECHNOLOGICAL FIELD

The present disclosure relates to packaging and packaging blanks for creating packaging devices and packaging inserts for housing an aerosol delivery device and consumable components for use with aerosol delivery devices.

BACKGROUND

Popular smoking articles, such as cigarettes, conventionally have been sold in packages. Typically, each full package contains about 20 cigarettes. Cigarettes have been packaged in containers known as so-called "soft packs." See, for example, U.S. Pat. No. 3,695,422 to Tripodi; U.S. Pat. No. 4,717,017 to Sprinkel, Jr., et al.; and U.S. Pat. No. 5,333,729 to Wolfe, all of which are incorporated herein by reference. Cigarettes have also been packaged in containers known as so-called "hard packs" or "crush proof boxes." See, for example, U.S. Pat. No. 3,874,581 to Fox et al.; U.S. Pat. No. 3,944,066 to Niepmann; and U.S. Pat. No. 4,852,734 to Allen et al., all of which are incorporated herein by reference.

However, many smoking devices have been proposed through the years as improvements upon, or alternatives to, smoking products that require combusting tobacco for use. Many of those devices purportedly have been designed to provide the sensations associated with cigarette, cigar, or pipe smoking, but without delivering considerable quantities of incomplete combustion and pyrolysis products that result from the burning of tobacco. To this end, numerous alternative smoking products, such as, flavor generators, aerosol generators, and medicinal inhalers have been proposed. These devices utilize electrical energy to vaporize or heat a volatile material, or attempt to provide the sensations of cigarette, cigar, or pipe smoking without burning tobacco to a significant degree. See, for example, the various alternative smoking articles, aerosol delivery devices and heat generating sources set forth in the background art described in U.S. Pat. No. 7,726,320 to Robinson et al., U.S. Pat. App. Pub. No. 2013/0255702 to Griffith, Jr et al, U.S. Pat. App. Pub. No. 2014/0000638 to Sebastian et al, U.S. Pat. App. Pub. No, 2014/0060554 to Collett et al, and U.S. Pat. App. Pub. No. 2014/0096781 to Sears et al, which are all incorporated herein by reference.

Furthermore, aerosol delivery devices include, for example, vapor products commonly known as "electronic cigarettes," "e-cigarettes" or electronic nicotine delivery systems (ENDS), as well as heat-not-burn products including tobacco heating products (THPs) and carbon-tipped tobacco heating products (CTHPs). Many of these products take the form of a system including a device and a consumable, and it is the consumable that includes the material from which the substance to be delivered originates. Typically, the device is reusable, and the consumable is single-use (although some consumables are refillable). Therefore, in many cases, the consumable is sold separately from the device, and often in a multipack. Moreover, subsystems and some individual components of devices or consumables may be sourced from specialist manufacturers.

Many aerosol delivery devices and in particular non-combustible aerosol provision systems include consumable components, such as cartridges to store an aerosol precursor useable in conjunction with a control body of an aerosol delivery device to form an aerosol and simulate smoking. The cartridges or other containers useable in conjunction with an aerosol delivery device may differ in size or shape from traditional smoking articles. These components generally require packaging for storage, transport, etc.

Thus, advances with respect to packaging devices that are formed from specialized blanks for packaging one or more consumable component would be desirable.

BRIEF SUMMARY

Example implementations of the present disclosure are directed to the concept of a packaging device including outer and inner packages configured to hold a consumer product such as disposable cartridges for an aerosol delivery device.

The present disclosure includes, without limitation, the following example implementations.

Some example implementations provide a packaging device configurable between an open configuration and a closed configuration. The packaging device includes an outer package comprising a first plurality of panels configurable to define an inner cavity substantially enclosed by the panels in the closed configuration. The outer package includes a reconfigurable portion and a base portion, where the reconfigurable portion is configured to move relative to the base portion to define an opening to the inner cavity and to engage the base portion in the closed configuration. The packaging device also includes an insert having a second plurality of panels configured to form an inlay disposable within the outer package. The inlay has an external shape corresponding to an internal shape of the inner cavity and at least one of the second plurality of panels comprises a plurality of openings substantially evenly distributed across the at least one panel and configured to hold one or more components.

In some example implementations of the packaging device of any preceding example implementation, or any combination of any preceding example implementations, an additional panel of the second plurality of panels includes a second plurality of openings substantially evenly distributed across the additional panel and substantially aligned with the first plurality of openings when the second plurality of panels are configured to form the inlay. The second plurality of openings are also configured to hold the one or more components.

In some example implementations of the packaging device of any preceding example implementation, or any combination of any preceding example implementations, the first plurality of panels is embodied in a first blank having a first surface and a second surface. The first blank comprises a back panel having first and second lateral sides and first and second longitudinal ends; a first intermediate panel extending from the first lateral side of the back panel; a second intermediate panel extending from the second lateral side of the back panel; a first end panel extending from the first longitudinal end of the back panel and comprising an end tab, a first side tab, and a second side tab, each extending from a side of the first end panel, with an adhesive material at least partially disposed on the first surface of the first end panel; a second end panel extending from the second longitudinal end of the back panel and comprising an end tab, a first side tab, and a second side tab, each extending from a side of the second end panel, with the adhesive material at least partially disposed on the first surface of the first end panel; an inside panel extending from the first intermediate panel and comprising first and second lateral sides, first and second longitudinal ends, a first flap extending from the first longitudinal end of the inside panel, and a second flap extending from the second longitudinal end of the inside panel, the second surface of the inside panel configured to engage the first and second end panels via the adhesive, where a portion of the first intermediate panel and the second lateral side of the inside panel define a receptacle; and a front panel extending from the second intermediate panel and comprising first and second lateral sides, first and second longitudinal ends, and a tab extending outwardly from the second lateral side of the front panel, wherein the front panel is configured to at least partially overlap the inside panel and the tab is configured to removably engage the receptacle in the closed configuration. The back panel, the first intermediate panel, the first and second end panels, and the inside panel are configured to form the base portion and define the inner cavity when assembled. The second intermediate panel and the front panel are configured to form the reconfigurable portion.

In some other example implementations of the packaging device of any preceding example implementation, or any combination of any preceding example implementations, the first plurality of panels is embodied in a first blank having a first surface and a second surface. The first blank comprises a back panel having first and second lateral sides and first and second longitudinal ends; a first side panel extending from the first lateral side of the back panel and having a first flap extending from a first longitudinal end of the first side panel and a second flap extending from a second longitudinal end of the first side panel; an engagement panel extending from the second lateral side of the back panel, with an adhesive material at least partially disposed on the first surface of the engagement panel; a first end panel extending from the first longitudinal end of the back panel and having a first end flap extending from a distal end of the first end panel; a second end panel extending from the second longitudinal end of the back panel and having a second end flap extending from a distal end of the second end panel; a front panel extending from the first lateral side of the first intermediate panel and having first and second lateral sides and first and second longitudinal ends, where each of the first and second longitudinal ends define a recess in the front panel; and a second side panel extending from the first lateral side of the front panel and having a first flap extending from a first longitudinal end of the side panel and a second flap extending from a second longitudinal end of the side panel, where the second surface of the second side panel is configured to overlap and engage with the engagement panel via the adhesive. The back panel, the first and second side panels, the front panel, and the engagement panel are configured to form the base portion and define the inner cavity when assembled. The first and second end panels comprise the reconfigurable portion. The first and second flaps of the first and second end panels are hingedly coupled to their respective end panels and configured to fold into the base portion in the closed configuration.

In some example implementations of the packaging device of any preceding example implementation, or any combination of any preceding example implementations, the second plurality of panels is embodied in a second blank having a first surface and a second surface. The second blank comprises a back panel having first and second lateral sides; a first side panel extending from the first lateral side of the back panel; a top panel extending from a lateral side of the first side panel, the top panel comprising a plurality of openings substantially evenly distributed across the top panel and configured to hold one or more components; a second side panel extending from a lateral side of the top panel; a first intermediate panel extending from the second lateral side of the back panel, with an adhesive material at least partially disposed on the first surface of the first intermediate panel, a bottom panel extending from a lateral side of the first intermediate panel, the bottom panel comprising a second plurality of openings substantially evenly distributed across the bottom panel and configured to hold one or more components, wherein the bottom panel is oriented generally parallel with the top panel when the second plurality of panels are configured to form the inlay, such that the second plurality of openings substantially align with the first plurality of openings; and a second intermediate panel extending from a lateral side of the bottom panel, with the adhesive material at least partially disposed on the first surface of the second intermediate panel. The first surface of the first intermediate panel is configured to engage the second surface of the second side panel and the first surface of the second intermediate panel is configured to engage with the second surface of the first side panel.

In some other example implementations of the packaging device of any preceding example implementation, or any combination of any preceding example implementations, the second plurality of panels is embodied in a second blank having a first surface and a second surface. The second blank comprises a back panel having first and second lateral sides and first and second longitudinal ends; a first side panel extending from the first lateral side of the back panel; a second side panel extending from the second lateral side of the back panel; a first upright panel extending from the first longitudinal end of the back panel; a second upright panel extending from the second longitudinal end of the back panel; a top panel extending from a lateral side of the second side panel, the top panel comprising a plurality of openings substantially evenly distributed across the top panel and configured to hold one or more components; a first intermediate panel extending from a lateral side of the top panel, with an adhesive material at least partially disposed on the first surface of the first intermediate panel; a spacer panel extending from a lateral side of the first intermediate panel, where the spacer panel is oriented generally parallel with the top panel when the second plurality of panels are configured to form the inlay; a second intermediate panel extending from a lateral side of the spacer panel, with the adhesive material at least partially disposed on the first surface of the second intermediate panel; a bottom panel extending from the second intermediate panel, the bottom panel comprising a second plurality of openings substantially evenly distributed across the bottom panel and configured to hold one or more components, where the bottom panel is oriented generally parallel with the top panel when the second plurality of panels are configured to form the inlay, such that the second plurality of openings substantially align with the first plurality of openings; and a third intermediate panel extending from a lateral side of the bottom panel, with the adhesive material at least partially disposed on the first surface of the third intermediate panel. The first surface of the first intermediate panel is configured to engage the second surface of the first side panel via the adhesive, the first surface of the second intermediate panel is configured to engage the second surface of the second side panel via the adhesive, and the first surface of the third intermediate panel is configured to engage the second surface of the first intermediate panel via the adhesive when the second plurality of panels are configured to form the inlay.

In some other example implementations of the packaging device of any preceding example implementation, or any combination of any preceding example implementations, the second plurality of panels is embodied in a second blank having a first surface and a second surface. The second blank comprises a first base panel having first and second lateral sides; a second base panel having first and second lateral sides, where the first lateral side of the second base panel is hingedly coupled to the second lateral side of the first base panel; a first top panel extending from the first lateral side of the first base panel and a first inner side panel extending from a lateral side of the first top panel, where the first top panel and the first inner side panel define a first plurality of openings substantially evenly distributed across the first top and first inner side panels and configured to hold one or more components; a second top panel extending form the second lateral side of the second base panel and a second inner side panel extending from a lateral side of the second top panel, where the second top panel and the second inner side panel define a second plurality of openings substantially evenly distributed across the second top and second inner side panels and configured to hold one or more components; a first outer side panel extending from a lateral side of the first inner side panel; a second outer side panel extending from a lateral side of the second inner side panel; a first intermediate panel extending from a lateral side of the first outer side panel; a second intermediate panel extending from a lateral side of the second outer side panel; a first extension panel extending from a lateral side of the first intermediate panel; and a second extension panel extending from a lateral side of the second intermediate panel.

When the second blank is in a folded configuration, the first surface of the first outer side panel engages the first surface of the first inner side panel via an adhesive or other means as disclosed herein, the first surface of the second outer side panel engages the first surface of the second inner side panel via the adhesive, the second surface of the first extension panel engages the second surface of the second extension panel via the adhesive, and the second surface of the first base panel is oriented towards the second surface of the second base panel so as to nest the engaged first inner and outer side panels and the engaged second inner and outer side panels therebetween and orient at least a portion of the first and second plurality of openings to receive the one or more components. In some implementations, the adjacent panels that are not adhered to one another may be slidably disposed relative to one another. Certain panels of the inlay are able to flex relative to certain other panels after the inlay is folded to allow for the inlay be at least partially collapsed relative to a neutral orientation.

In some example implementations of the packaging device of any preceding example implementation, or any combination of any preceding example implementations, the packaging device further comprises a second insert comprising a third plurality of panels. The third plurality of panels comprises a third blank having a first surface and a second surface. The third blank comprises a back panel having first and second lateral sides and first and second longitudinal ends; a first side panel extending from the first lateral side of the back panel; a second side panel extending from the second lateral side of the back panel; a first upright panel extending from the first longitudinal end of the back panel; a second upright panel extending from the second longitudinal end of the back panel; a top panel extending from a lateral side of the second side panel, the top panel comprising a plurality of openings substantially evenly distributed across the top panel and configured to hold one or more components; a first intermediate panel extending from a lateral side of the top panel, with an adhesive material at least partially disposed on the first surface of the first intermediate panel; a spacer panel extending from a lateral side of the first intermediate panel, where the spacer panel is oriented generally parallel with the top panel when the second plurality of panels are configured to form the inlay; a second intermediate panel extending from a lateral side of the spacer panel, with the adhesive material at least partially disposed on the first surface of the second intermediate panel; a bottom panel extending from the second intermediate panel, the bottom panel comprising a second plurality of openings substantially evenly distributed across the bottom panel and configured to hold one or more components, where the bottom panel is oriented generally parallel with the top panel when the second plurality of panels are configured to form the inlay, such that the second plurality of openings substantially align with the first plurality of openings; and a third intermediate panel extending from a lateral side of the bottom panel, with the adhesive material at least partially disposed on the first surface of the third intermediate panel. The first surface of the first intermediate panel is configured to engage the second surface of the first side panel via the adhesive, the first surface of the second intermediate panel is configured to engage the second surface of the second side panel via the adhesive, and the first surface of the third intermediate panel is configured to engage the second surface of the first intermediate panel via the adhesive when the second plurality of panels are configured to form the inlay.

In some other example implementations of the packaging device of any preceding example implementation, or any combination of any preceding example implementations, the plurality of openings comprises at least ten openings, at least twenty openings or any number of openings necessary to suit a particular application. In some implementations, the first insert is disposed at one end of the outer package and the second insert is disposed at an opposite end of the outer package such that, for example, a user may access the component from either end of the outer package.

Some example implementations provide a packaging device configurable between a planar configuration and a folded configuration to define a receptacle for retaining a component. The device includes an inner package blank having a first surface and a second surface. The inner package blank comprises a first engagement panel (A) having first and second lateral sides and first and second longitudinal ends, with an adhesive deposited over at least a portion of the first surface of the first engagement panel; a first inner side panel (B) having first and second lateral sides and first and second longitudinal ends, the panel (B) extending from the second lateral side of the first engagement panel (A); a support panel (C) having first and second lateral sides and first and second longitudinal ends, the panel (C) extending from the second lateral side of the first inner side panel (B), with the adhesive deposited over at least a portion of the second surface of the support panel; a second inner side panel (D) having first and second lateral sides and first and second longitudinal ends, the panel (D) extending from the second lateral side of the support panel (C); a second engagement panel (E) having first and second lateral sides and first and second longitudinal ends, the panel (E) extending from the second lateral side of the second inner side panel (D), with the adhesive deposited over at least a portion of the first surface of the second engagement panel; a third engagement panel (F) having first and second lateral sides and first and second longitudinal ends, the panel (F) extending from the second lateral side of the second engagement panel (E), with the adhesive deposited over at least a portion of the first surface of the third engagement panel; a back panel (G) having first and second lateral sides, first and second longitudinal ends, and first and second end flaps, the panel (G) extending from the second lateral side of the third engagement panel (F), with the adhesive deposited over at least a portion of the first surface of the first and second end flaps (alternatively or additionally, the adhesive may be deposited on a portion of the second surface of the back panel); a first outer side panel (H) having first and second lateral sides and first and second longitudinal ends, the panel (H) extending from the second lateral side of the back panel (G); a front panel (I) having first and second lateral sides, first and second longitudinal ends, and first and second end flaps, the panel (I) extending from the second lateral side of the first outer side panel (H), where the front panel defines at least one opening configured to form the receptacle configured to hold the component and with the adhesive deposited over at least a portion of the second surface of the front panel; and a second outer side panel (J) having first and second lateral sides and first and second longitudinal ends, the panel (J) extending from the second lateral side of the front panel (I), with the adhesive deposited over at least a portion of the second surface of the second outer side panel. When the packaging device is in the folded configuration, the second surface of the support panel (C) engages the second surface of the back panel (G) via the adhesive, the first engagement panel (A) and the second engagement panel (E) are folded inwardly to orient the first inner side panel (B) and the second inner side panel (D) substantially perpendicular to the back panel (G), the second surface of the front panel (I) engages the first surfaces of the first and second engagement panels (A), (E) via the adhesive, the second surface of the second outer side panel (J) engages the first surface of the third engagement panel (F), and the second surfaces of the first and second end flaps of the front panel (I) engage the first surfaces of the respective first and second end flaps of the back panel (G).

In some example implementations of the packaging device of any preceding example implementation, or any combination of any preceding example implementations, the packaging device further comprises an outer sleeve configured to slidably engage with an outer surface of the folded inner package blank. The outer sleeve comprises a sleeve blank having a first surface and a second surface. The blank comprises a back panel comprising first and second lateral sides and first and second longitudinal ends; a first engagement panel extending from the first lateral side of the back panel, wherein the adhesive is disposed on at least a portion of the first surface thereof; a first side panel extending from the second lateral side of the back panel; a front panel extending from a lateral side of the first side panel; and a second side panel extending from a lateral side of the front panel. The second surface of the second side panel at least partially overlaps and engages the first surface of the engagement panel via the adhesive, such that the front and back panels are substantially parallel.

In some example implementations of the packaging device of any preceding example implementation, or any combination of any preceding example implementations, the inner cavity provides a substantially uniform rectangular cross section along a lateral direction. The panels may be hingedly coupled to one another via fold lines created by stamping, indenting, pre-creasing, a series of perforations, or any combination thereof. Any one of the blanks may comprise paperboard, paper film laminations, corrugated board, chipboard, fiberboard, thermoplastic, or combinations thereof. Additionally, any one of the blanks may comprise indicia, such as an ornamental design, identifying information, or a date code. The inlay may be removably secured within the inner cavity of the outer package via, for example, an adhesive or a friction fit.

Some example implementations provide a method for forming a package. The method comprises providing a first blank comprising a first plurality of panels; configuring (e.g., folding) the first blank so that the first plurality of panels forms a base portion defining an inner cavity and a reconfigurable portion moveable relative to the base portion to have an open configuration and a closed configuration; providing a second blank comprising a second plurality of panels; configuring (e.g., folding) the second blank to form an inlay having an external shape corresponding to an internal shape of the inner cavity and having at least one panel with a plurality of openings substantially evenly distributed across the at least one panel and configured to hold one or more components; and positioning the inlay into the inner cavity of the base portion so that the one or more components is accessible to a user in the open configuration and the reconfigurable portion engages the base portion in the closed configuration to enclose the components. The method may include positioning the inlay into the inner cavity of the base portion comprises removably securing the inlay within the inner cavity via, for example, an adhesive or a friction fit. Additionally, the method may include printing indicia, such as an ornamental design, identifying information, or a date code on at least one of the panels.

These and other features, aspects, and advantages of the present disclosure will be apparent from a reading of the following detailed description together with the accompanying figures, which are briefly described below. The present disclosure includes any combination of two, three, four or more features or elements set forth in this disclosure, regardless of whether such features or elements are expressly combined or otherwise recited in a specific example implementation described herein. This disclosure is intended to be read holistically such that any separable features or elements of the disclosure, in any of its aspects and example implementations, should be viewed as combinable, unless the context of the disclosure clearly dictates otherwise.

It will therefore be appreciated that this Brief Summary is provided merely for purposes of summarizing some example implementations so as to provide a basic understanding of some aspects of the disclosure. Accordingly, it will be appreciated that the above described example implementations are merely examples and should not be construed to narrow the scope or spirit of the disclosure in any way. Other example implementations, aspects and advantages will become apparent from the following detailed description taken in conjunction with the accompanying figures which illustrate, by way of example, the principles of some described example implementations.

BRIEF DESCRIPTION OF THE FIGURES

Figure 1:
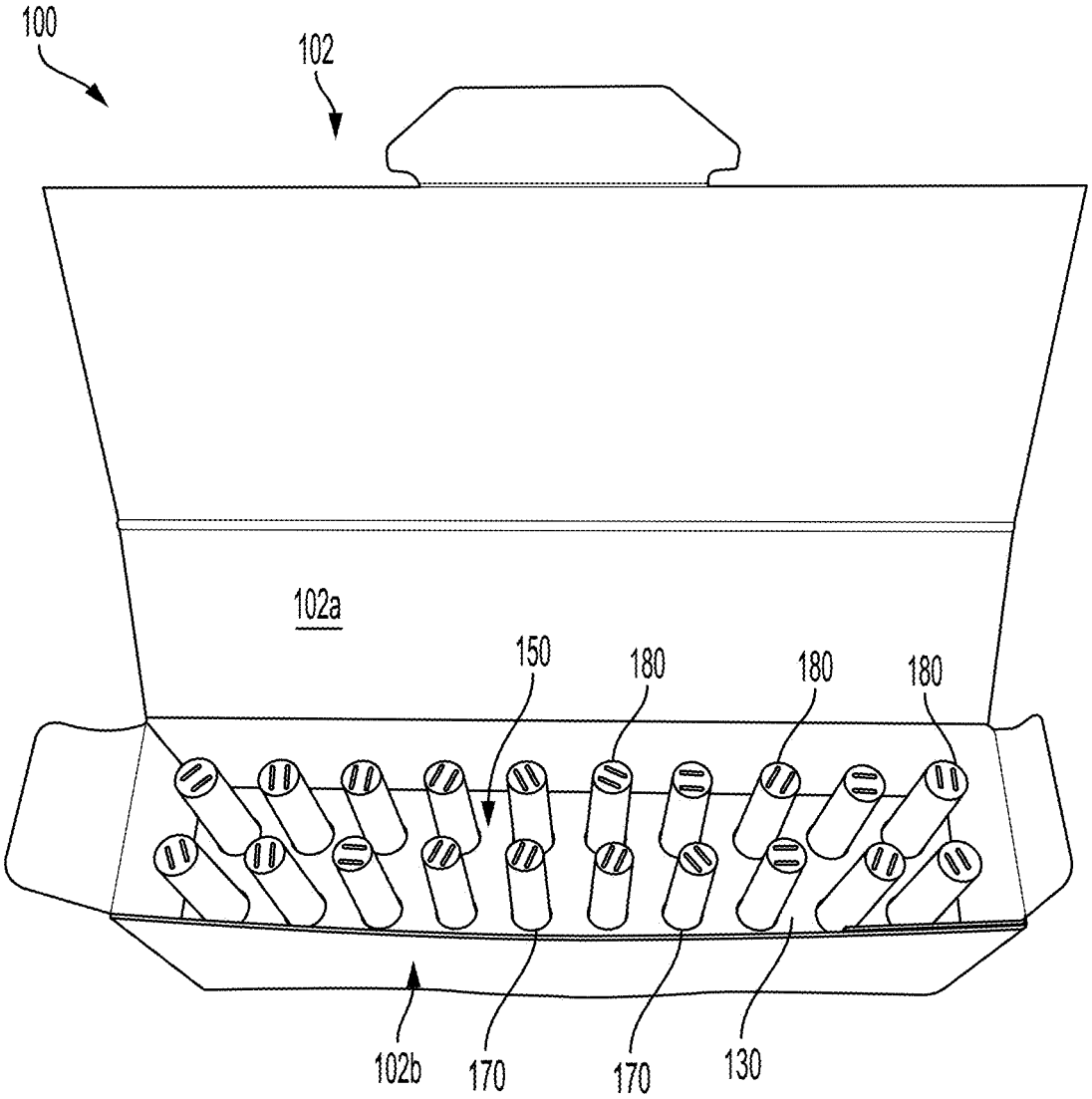
Figure 2:
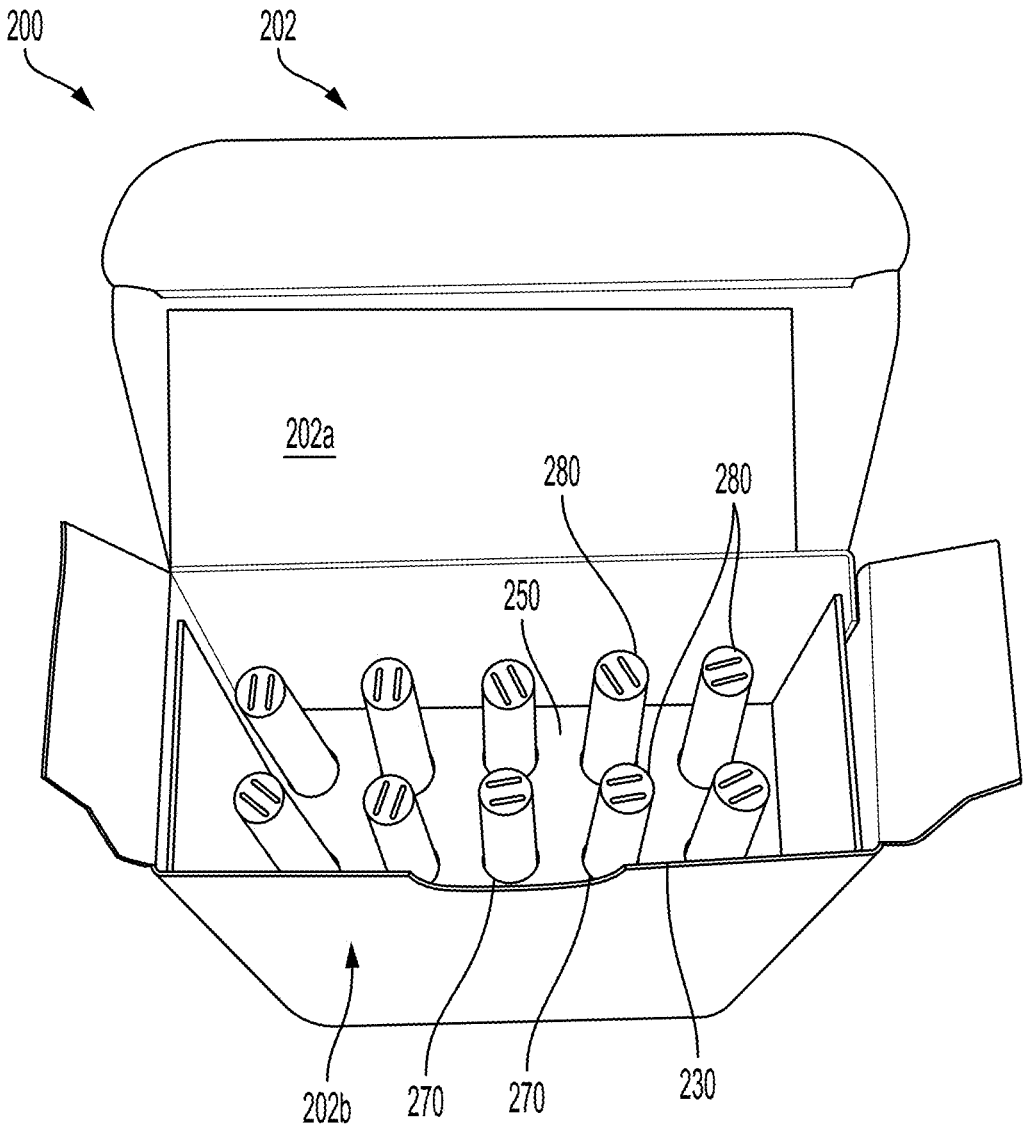
Figure 3:
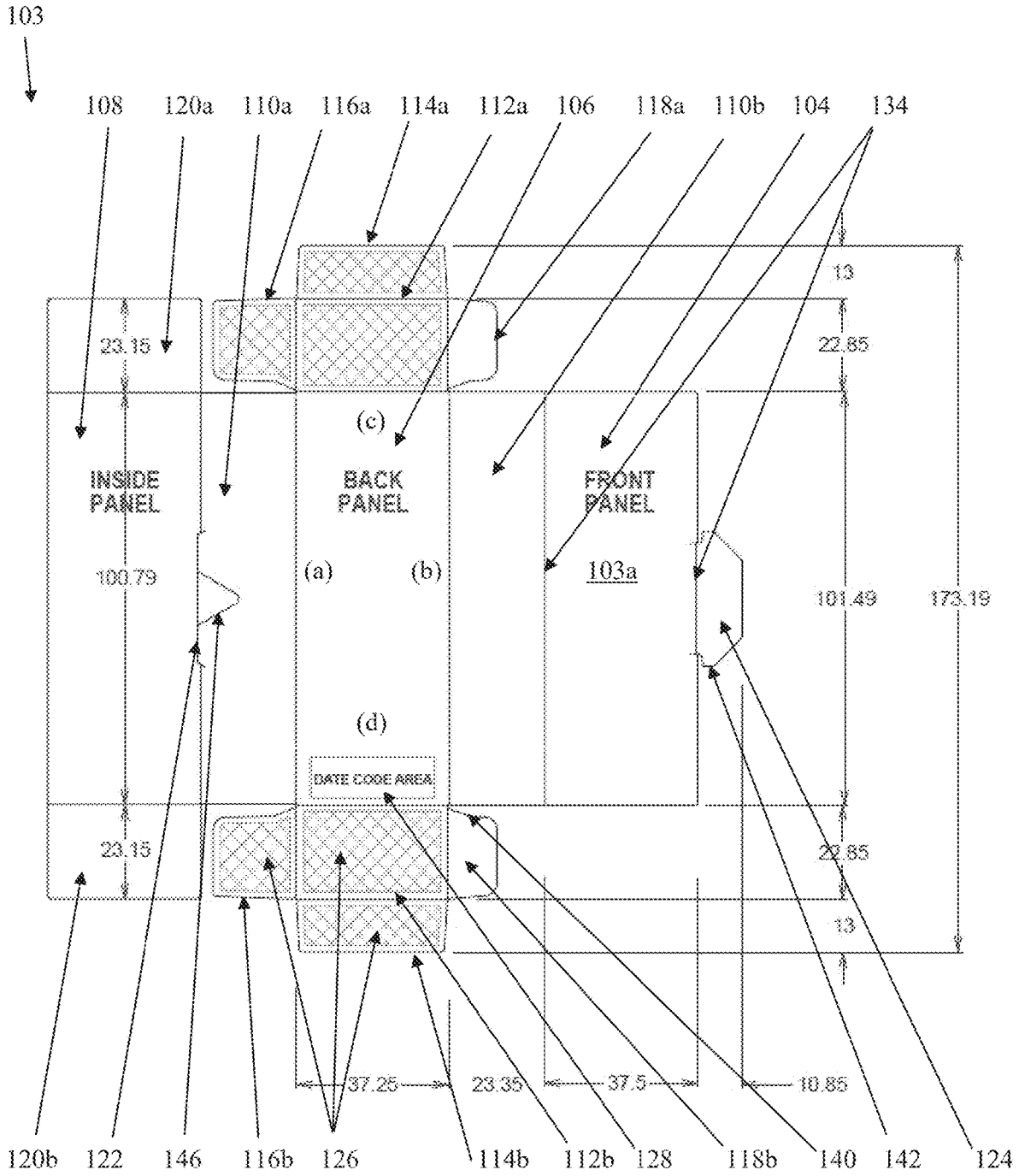
Figure 4:
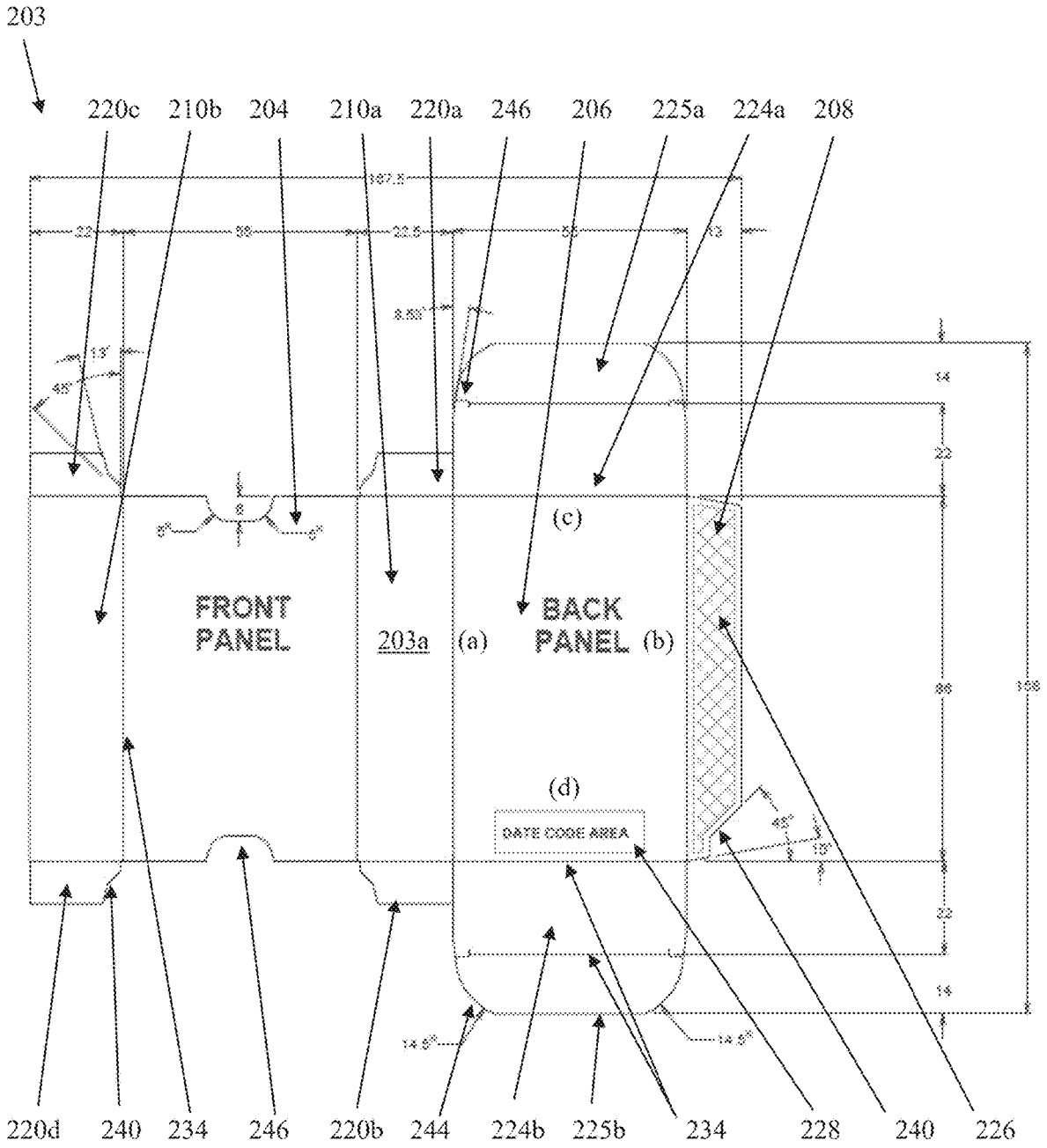
Figure 5:
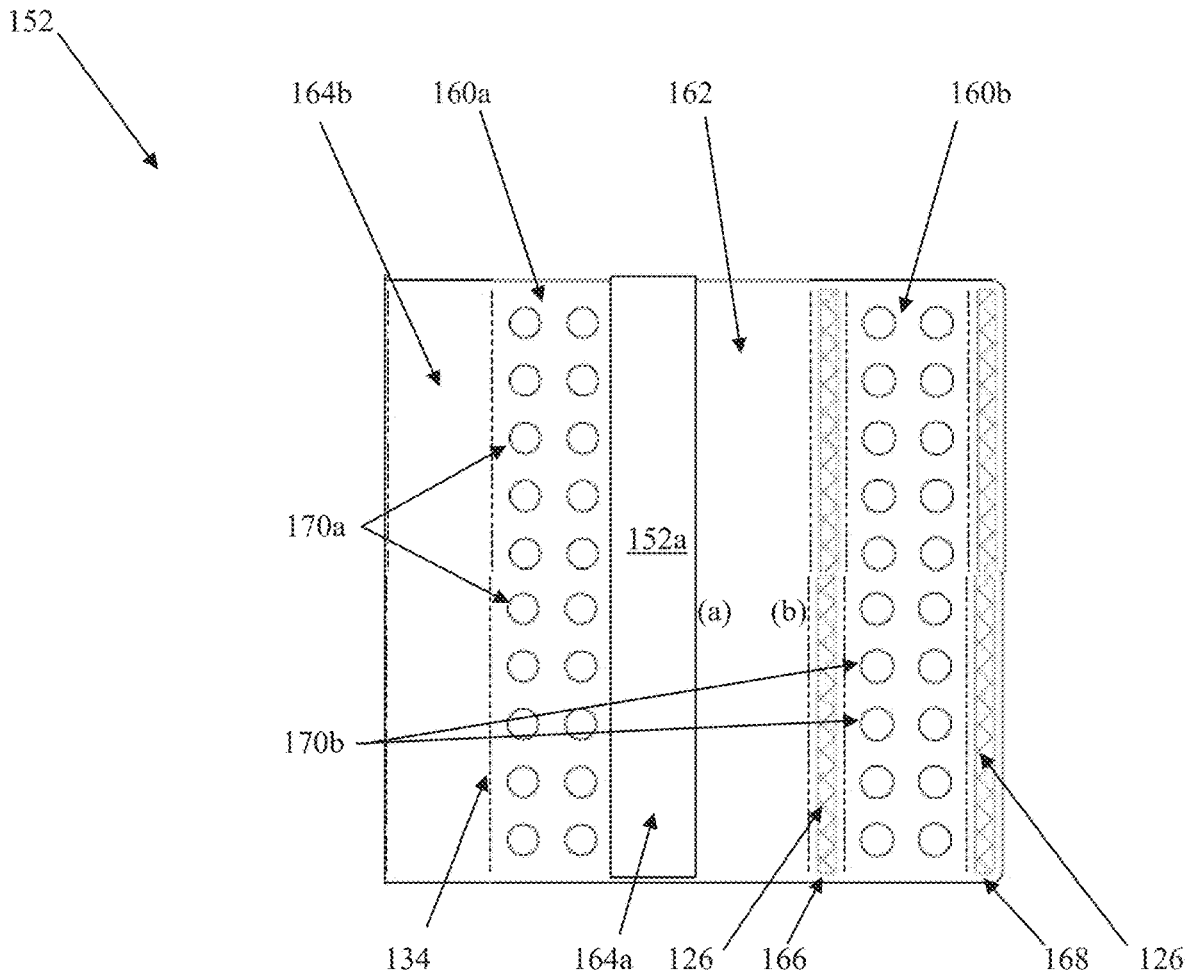
Figure 6:
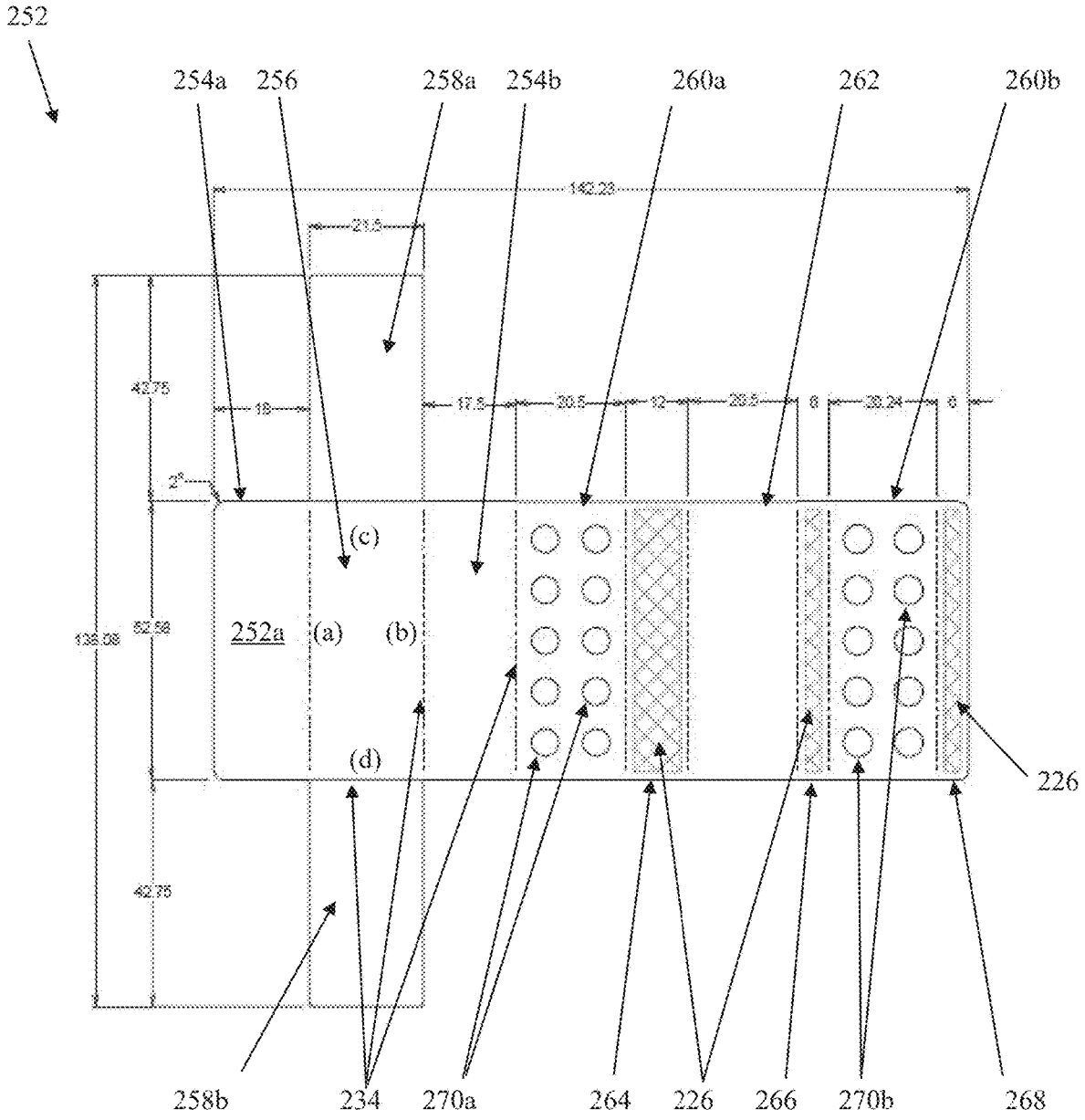
Figure 7:
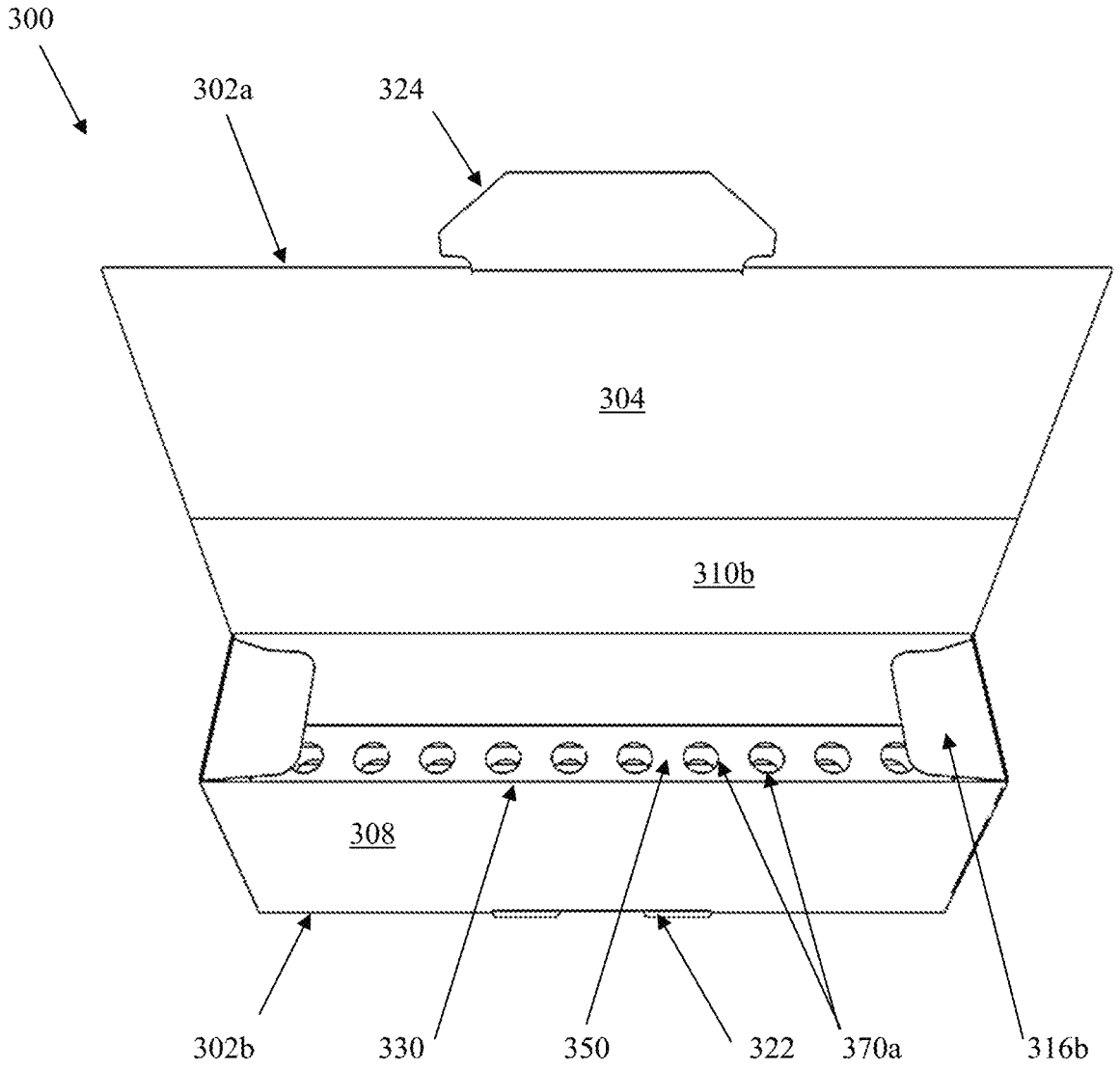
Figure 8:
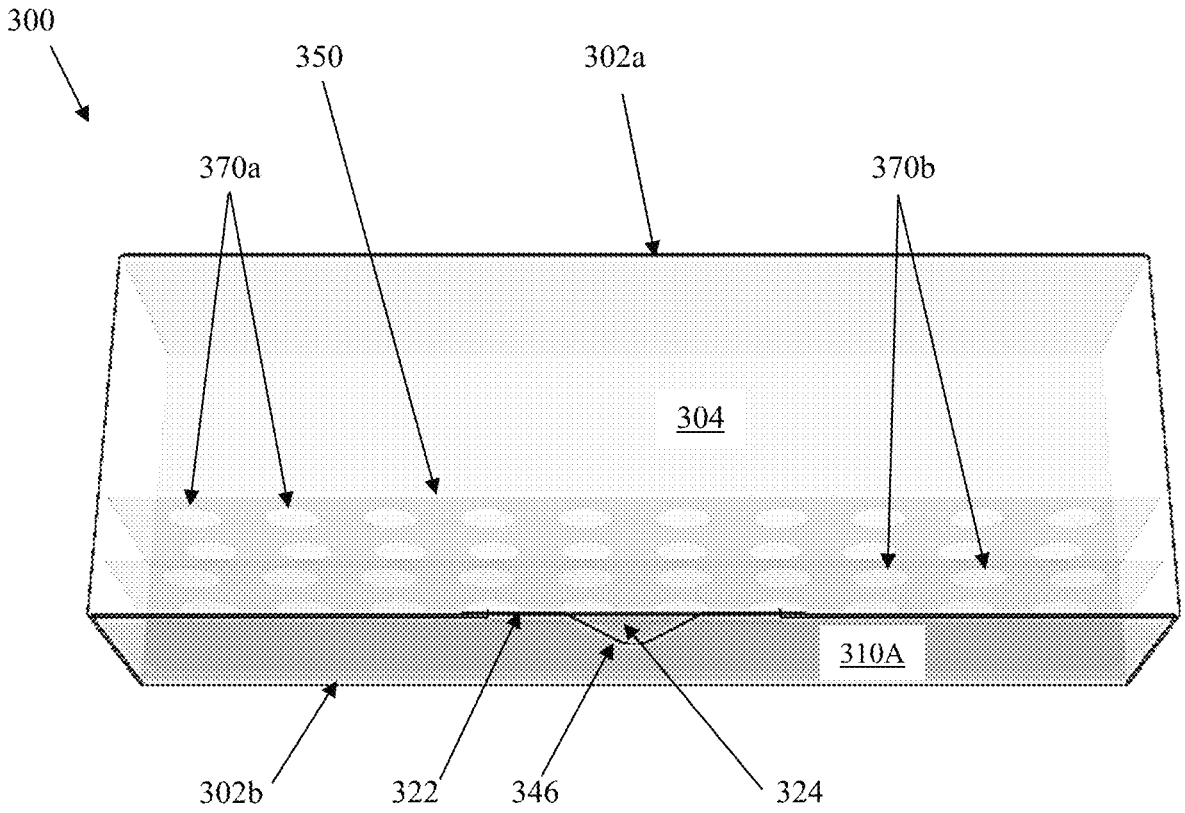
Figure 9:
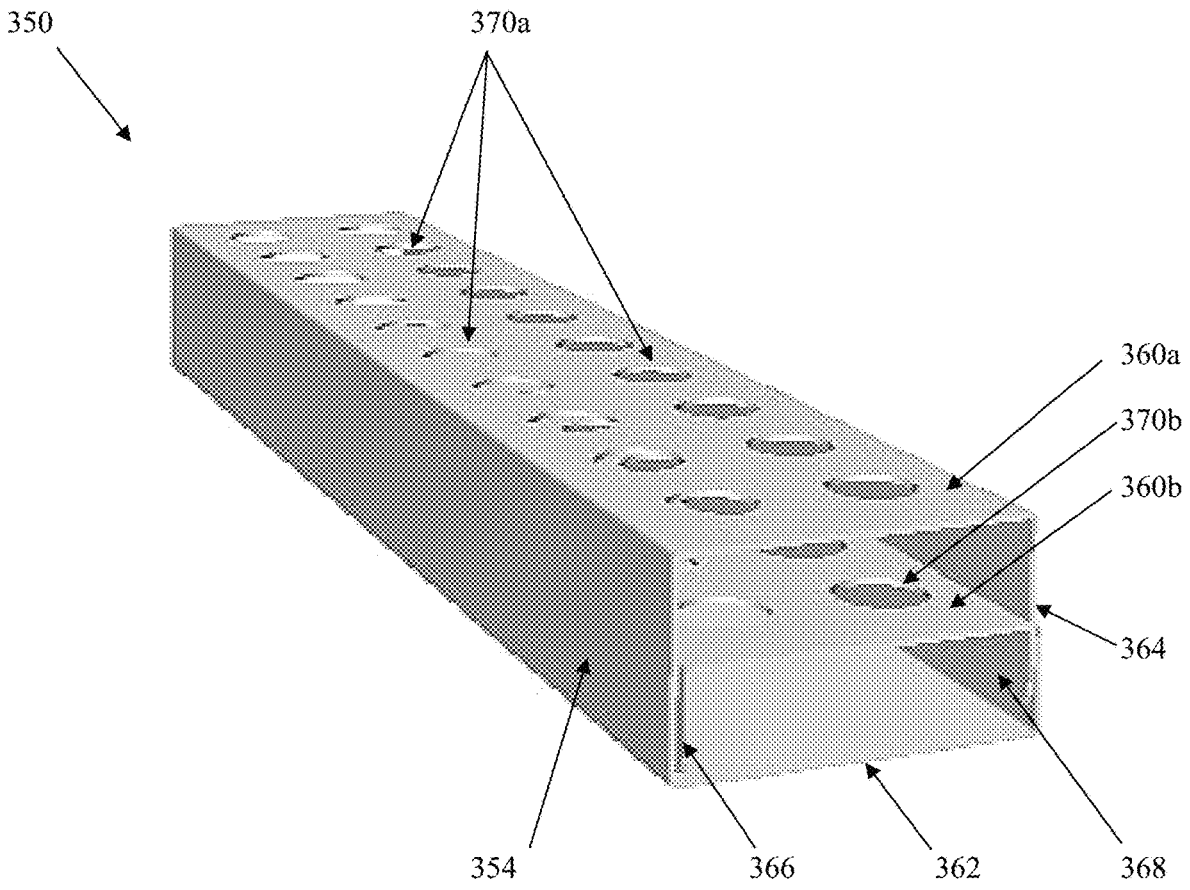
Figure 10:
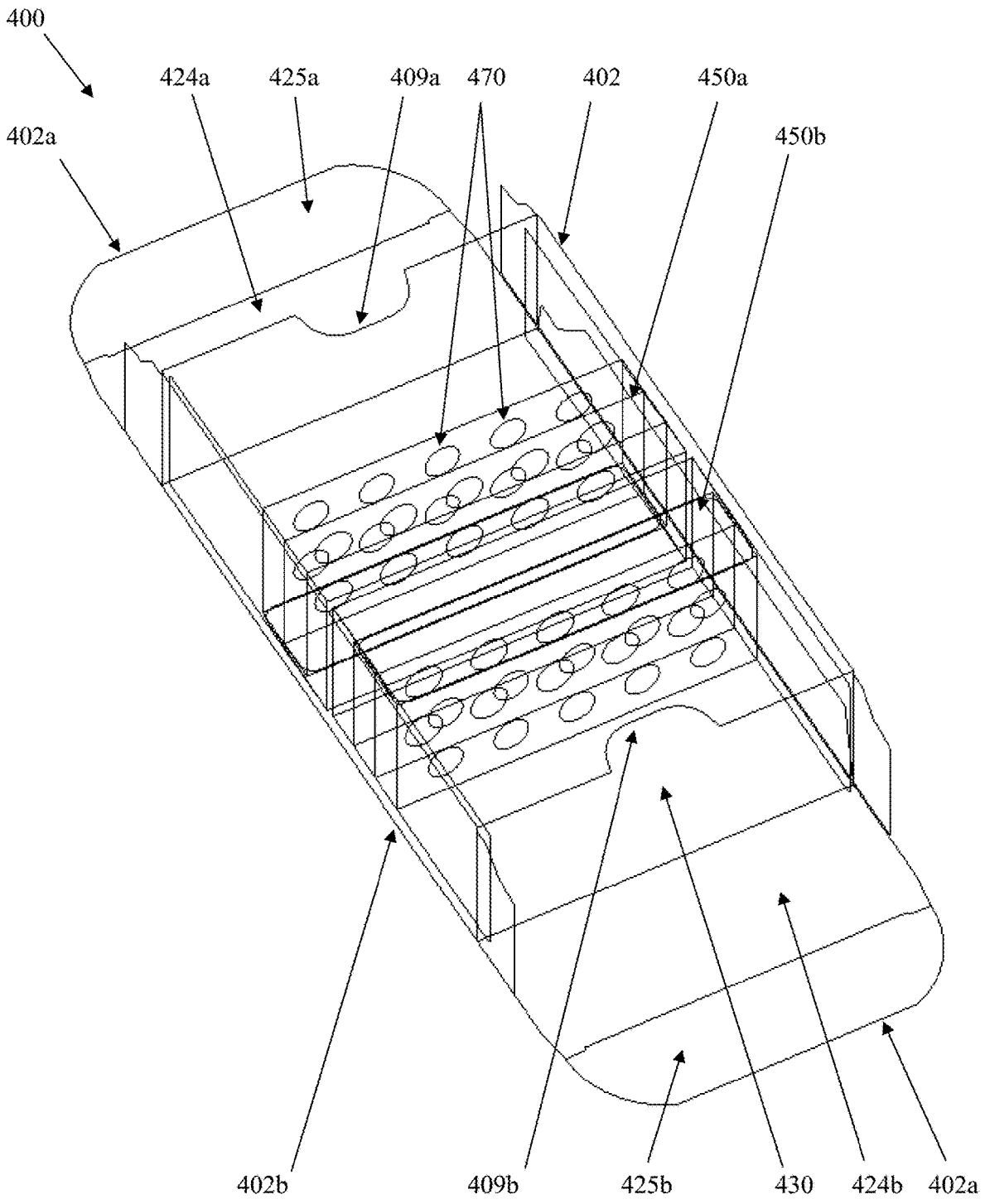
Figure 11A:
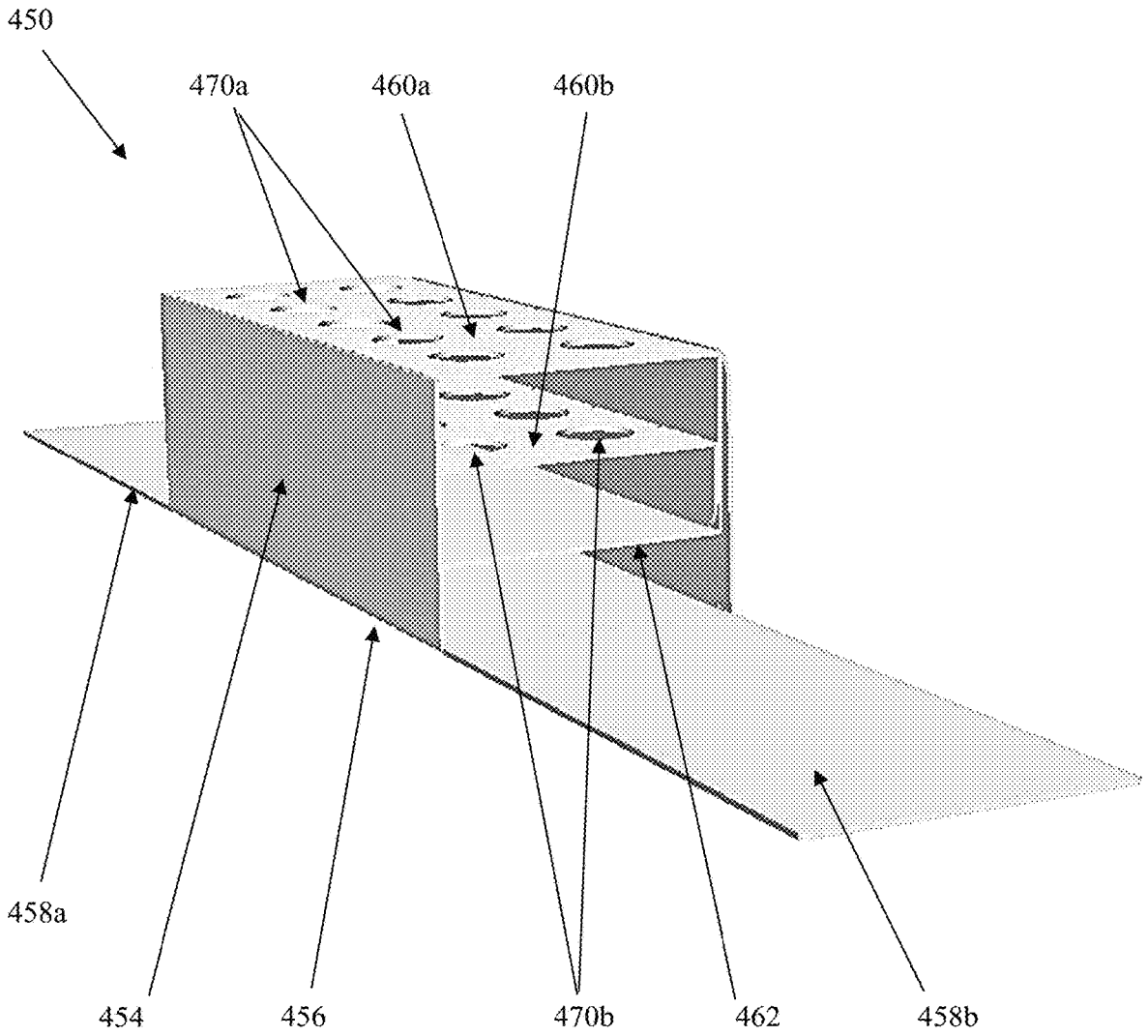
Figure 11B:
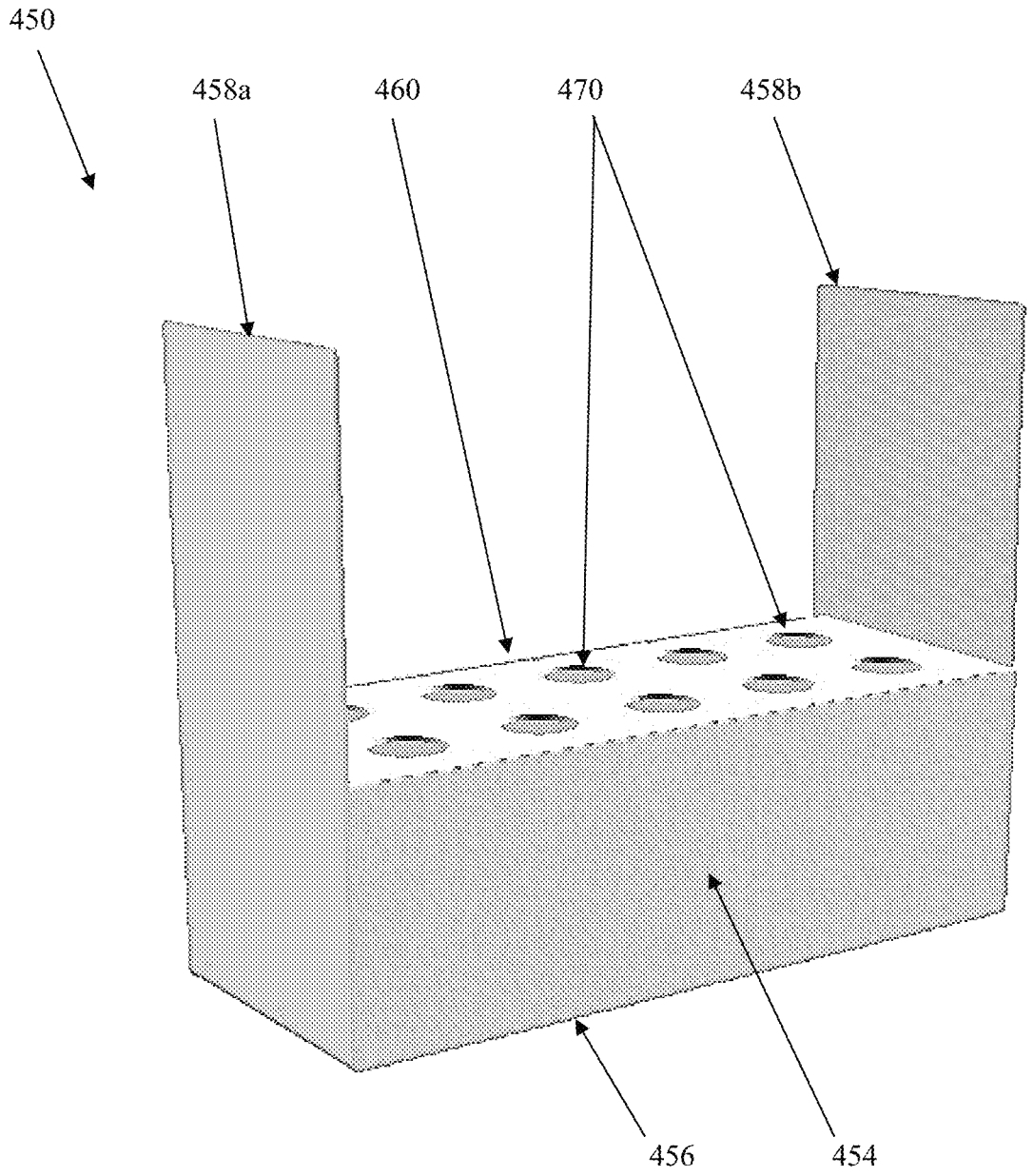
Figure 11C:
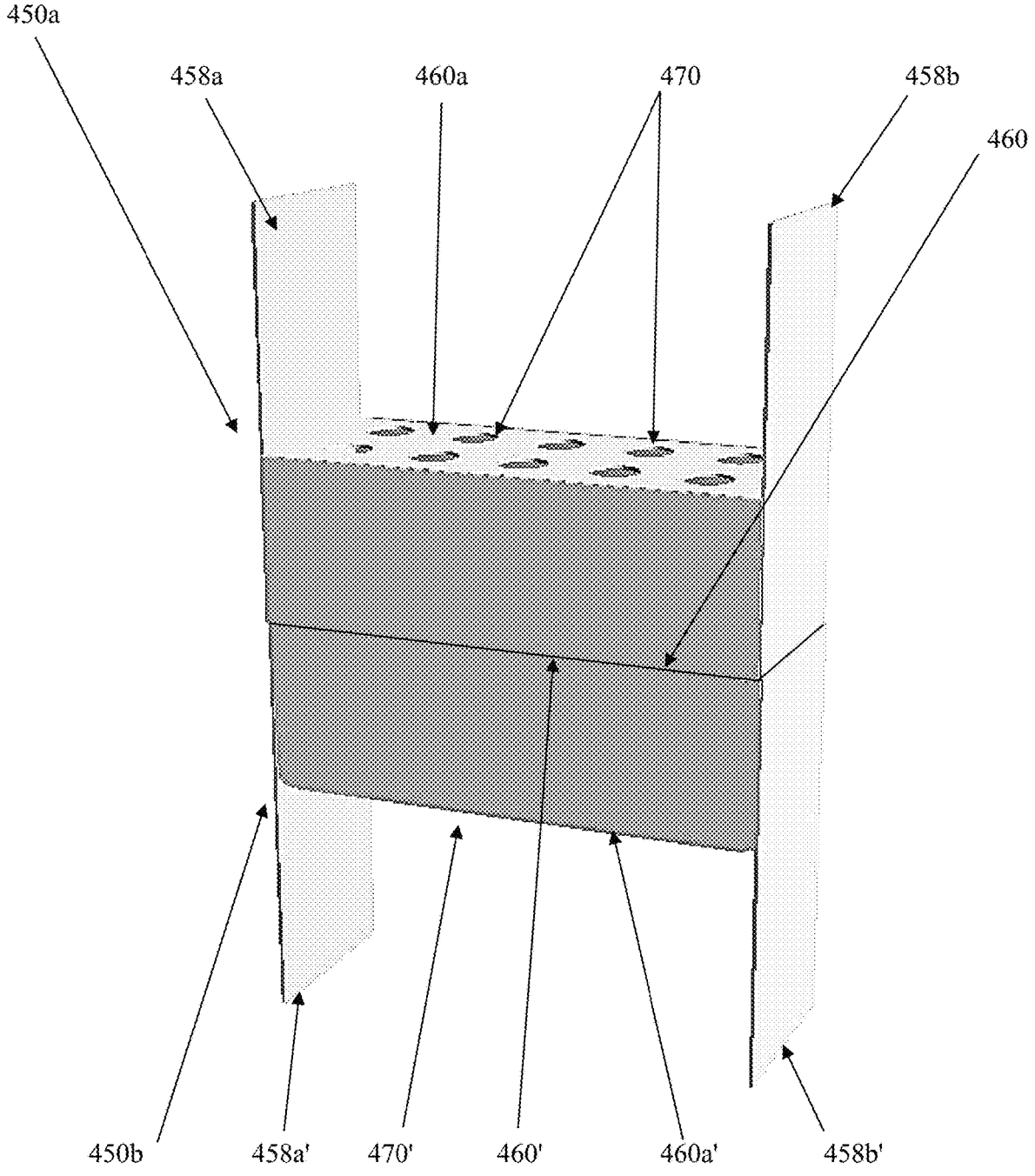
Figure 12:
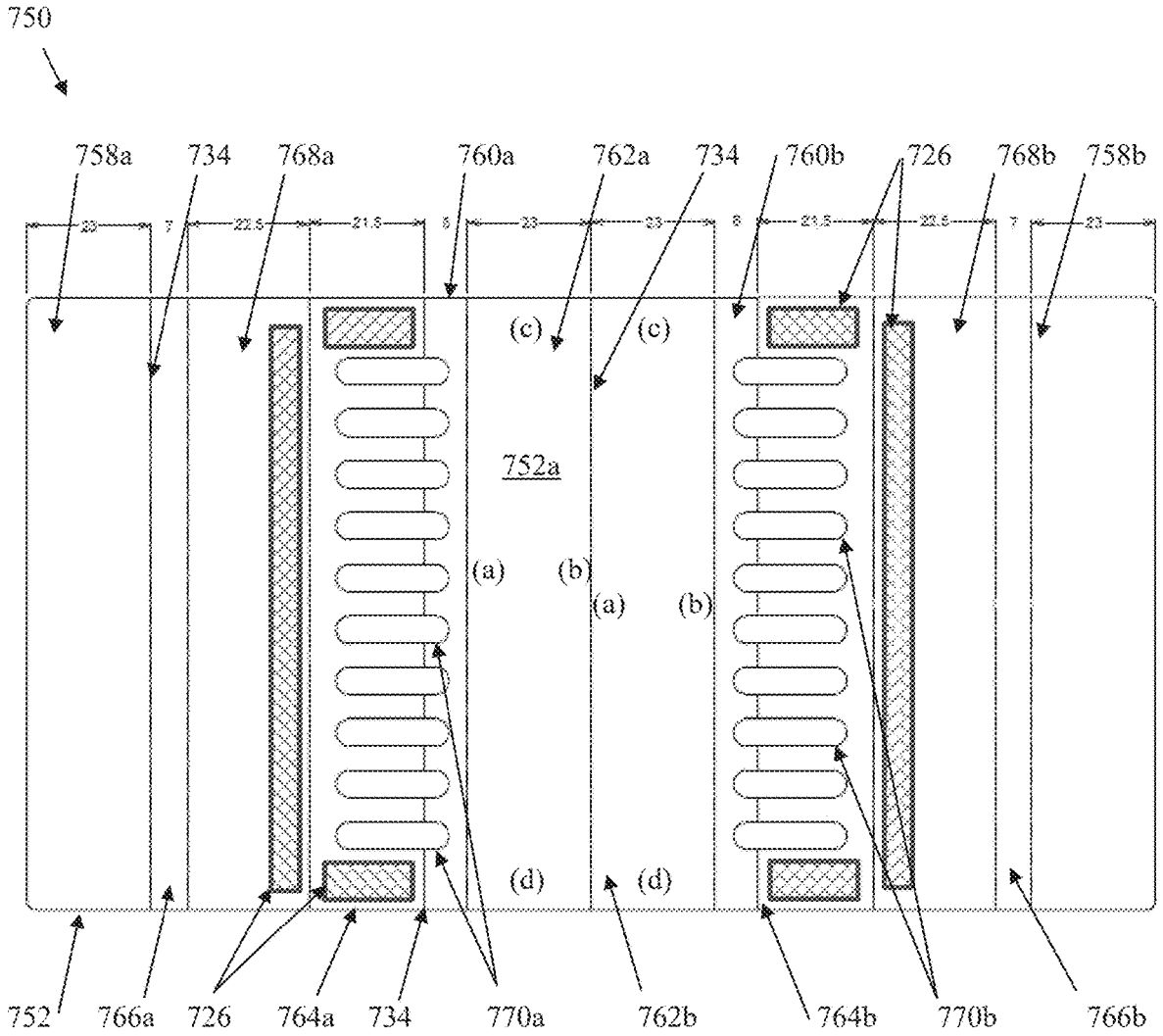
Figure 13A:
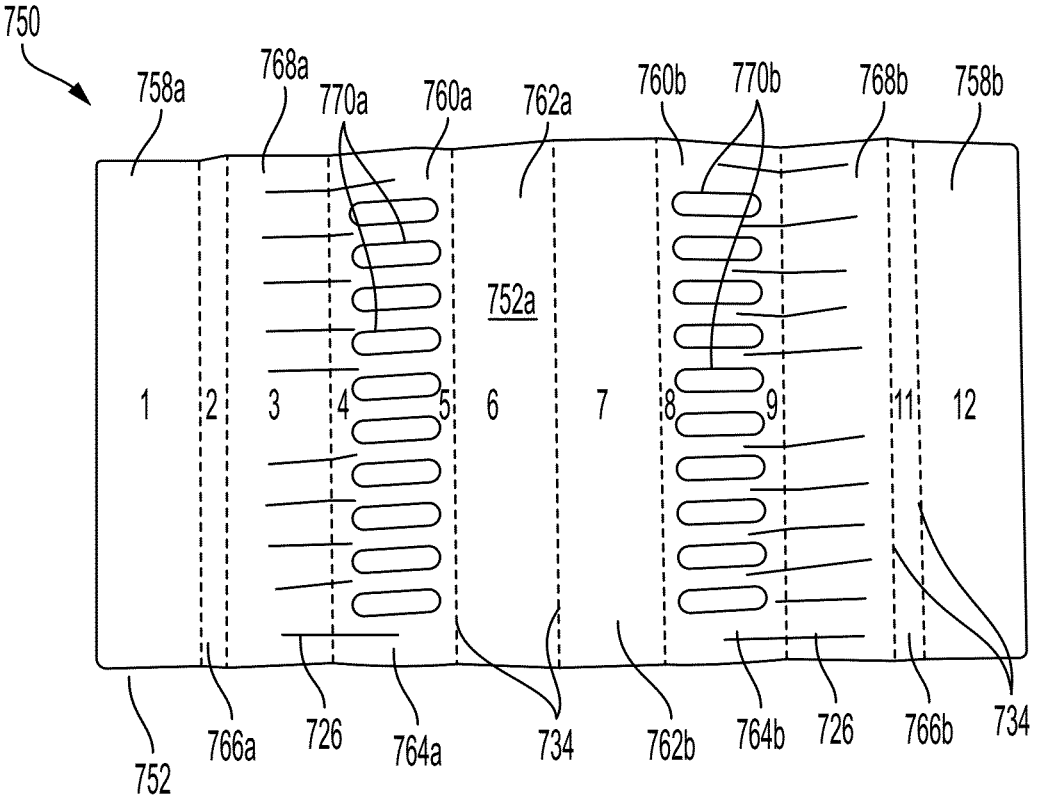
Figure 13B:
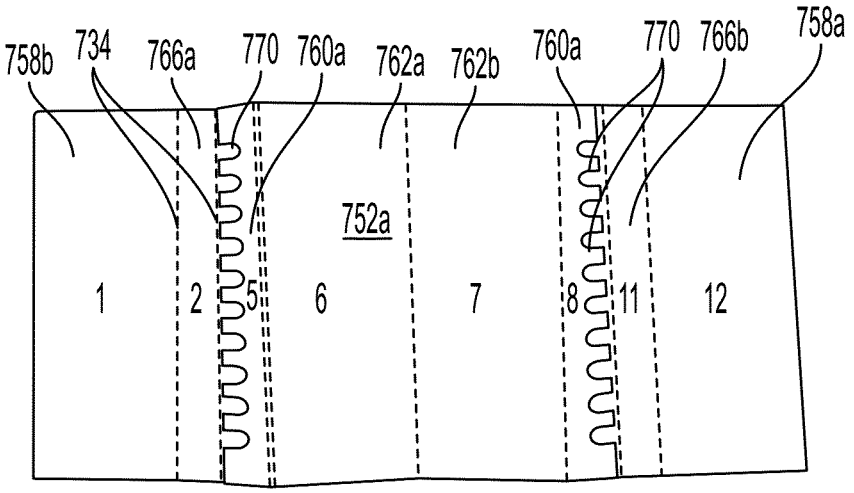
Figure 13C:
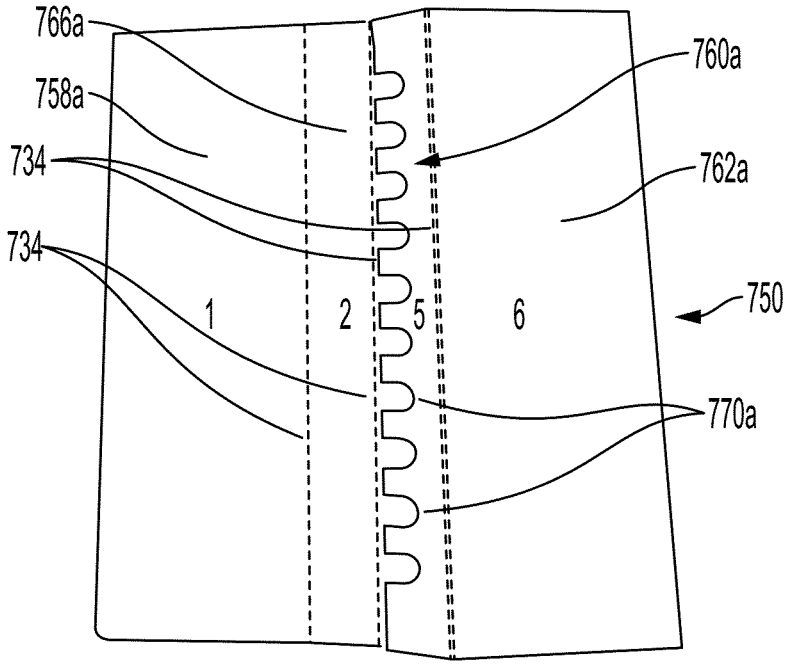
Figure 13D:
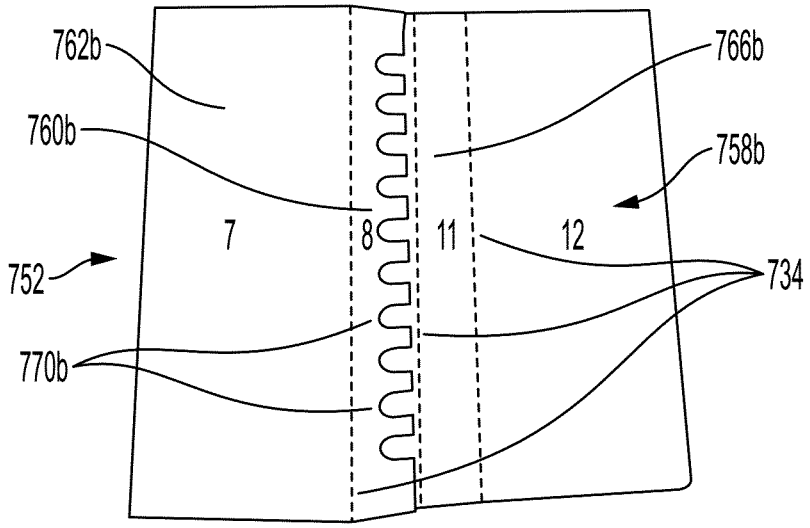
Figure 13E:
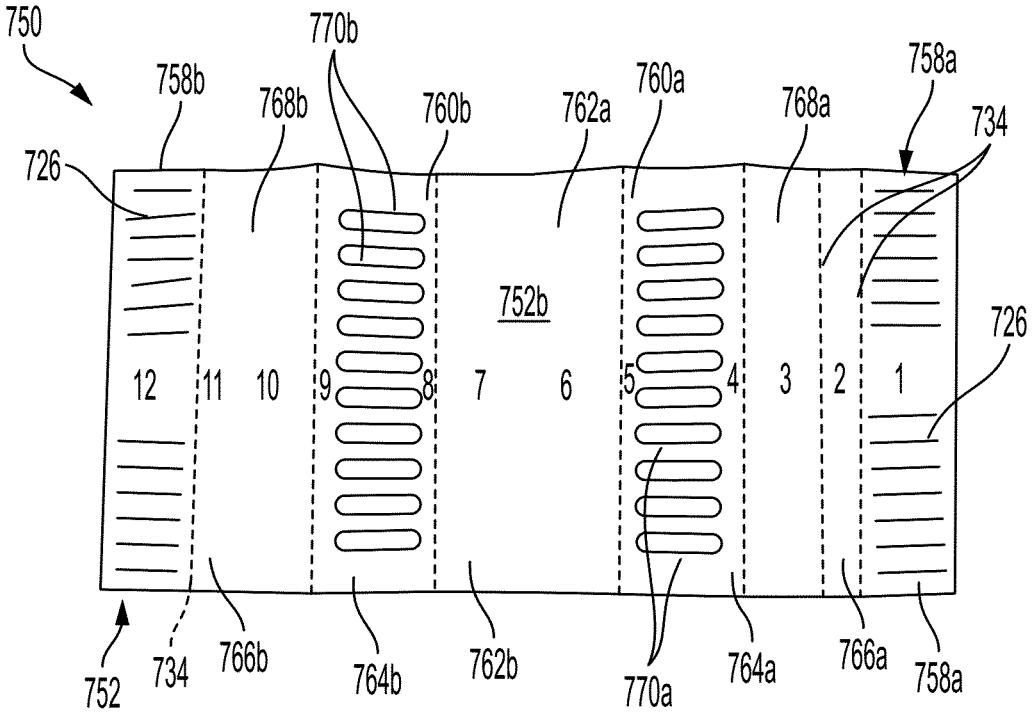
Figure 13F:
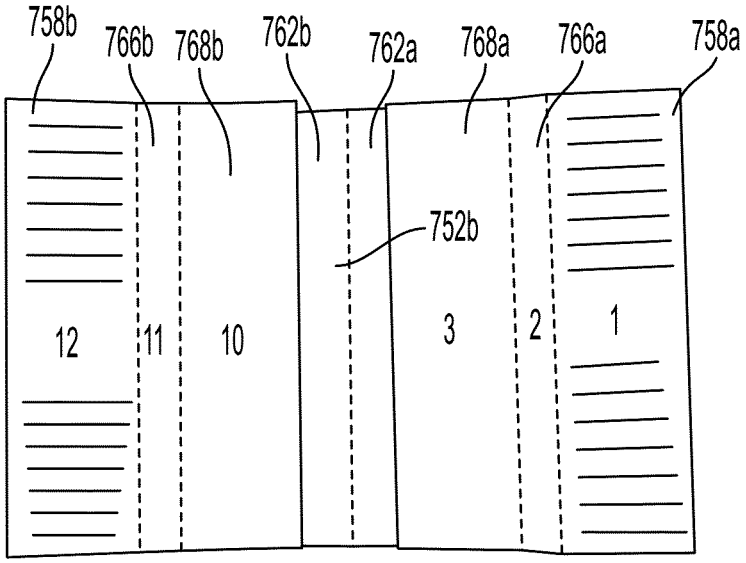
Figure 14A:
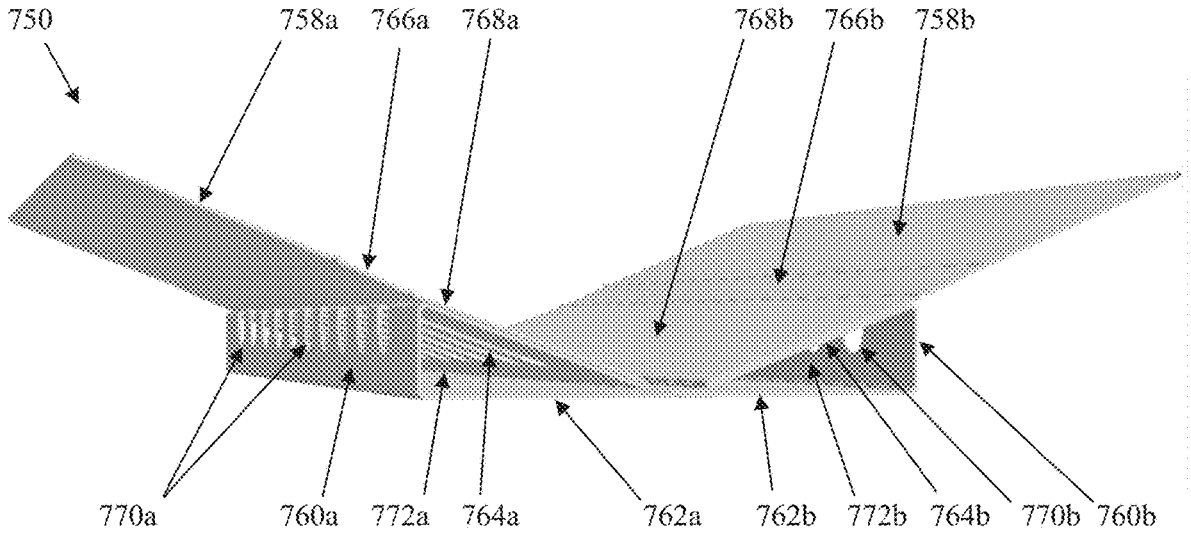
Figure 14B:
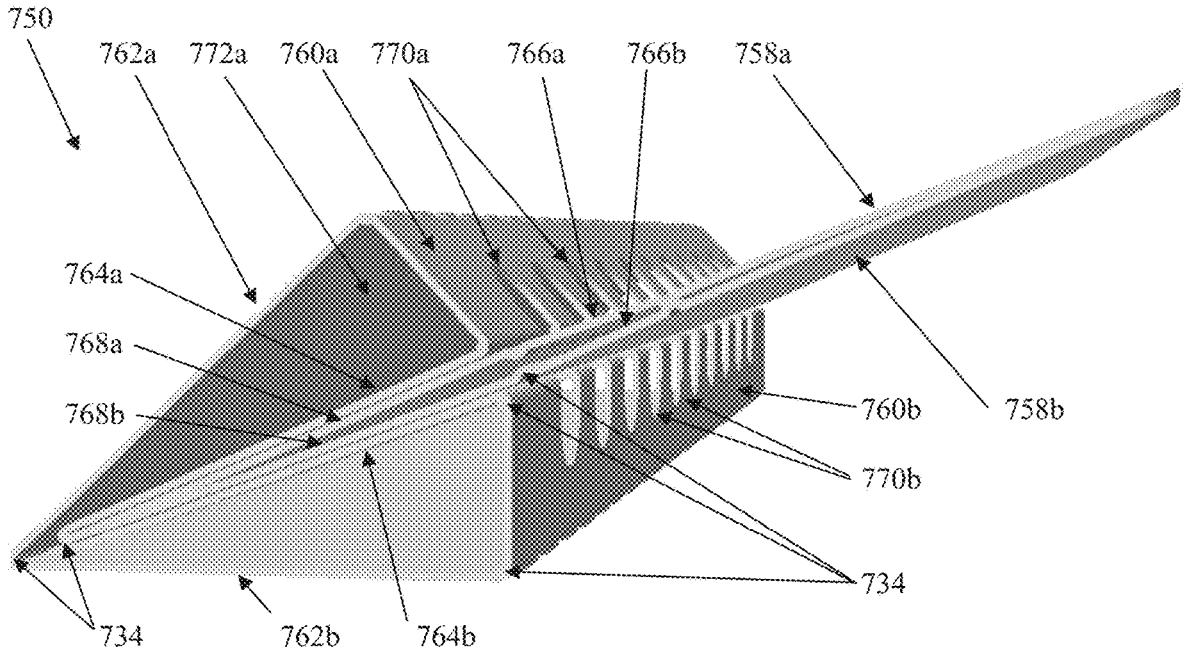
Figure 14C:
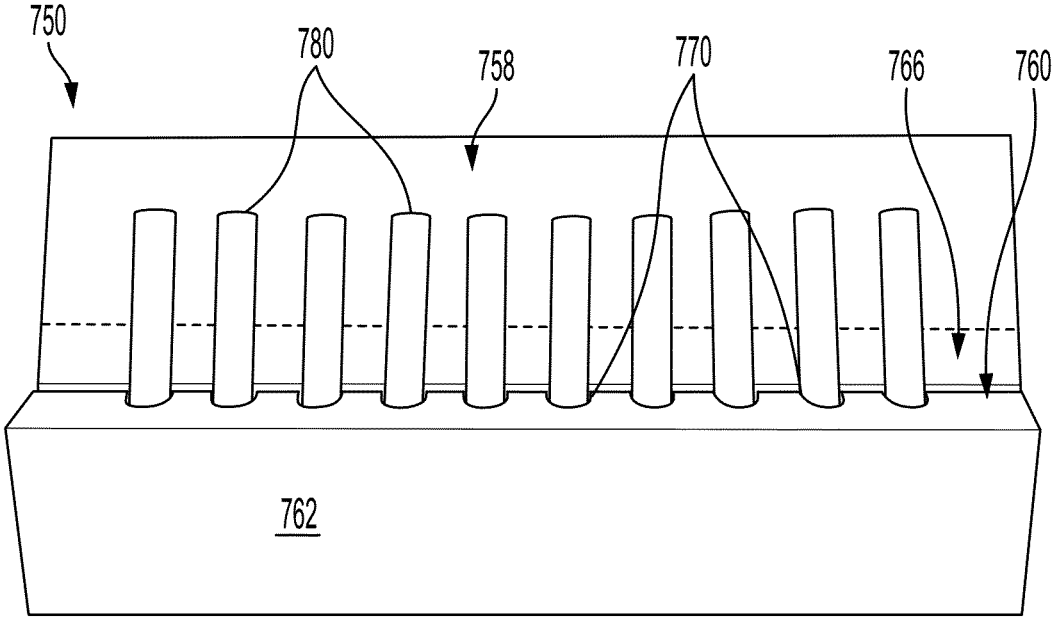
Figure 14D:
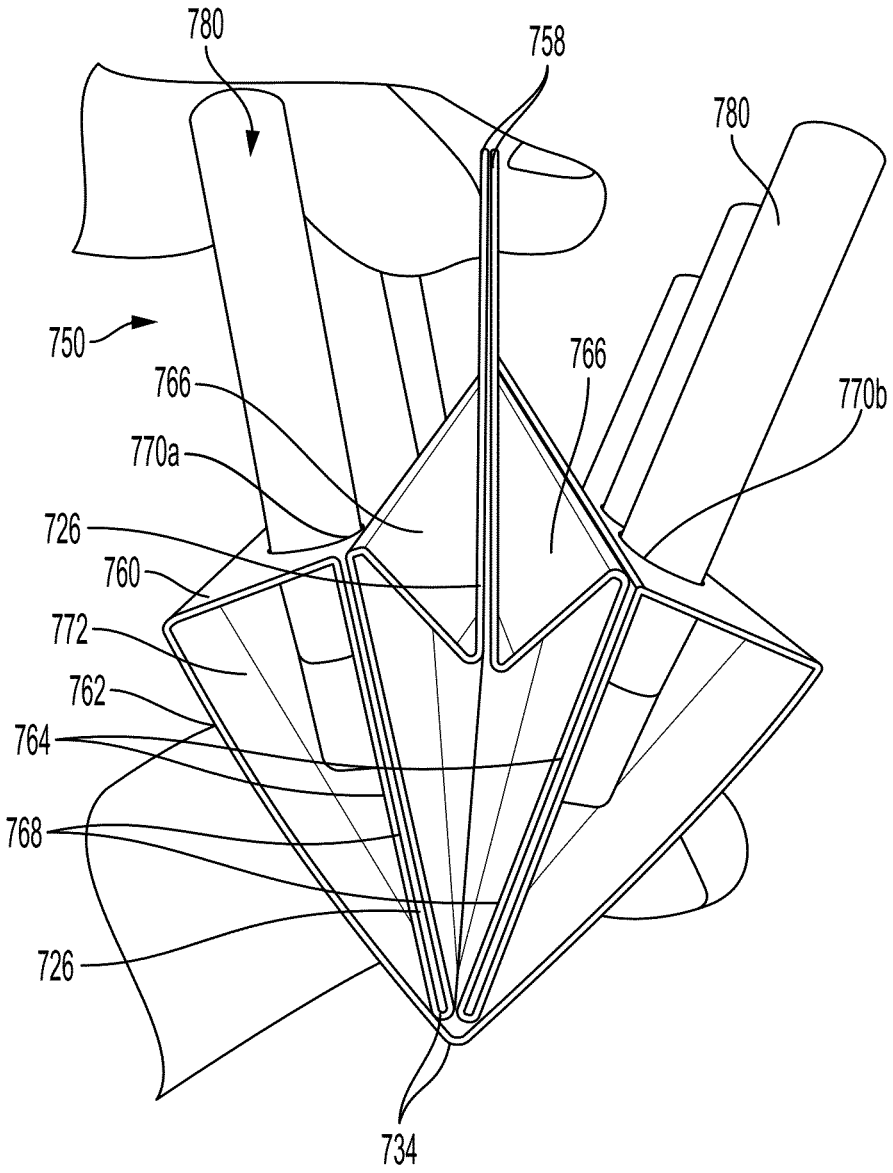
Figure 15A:
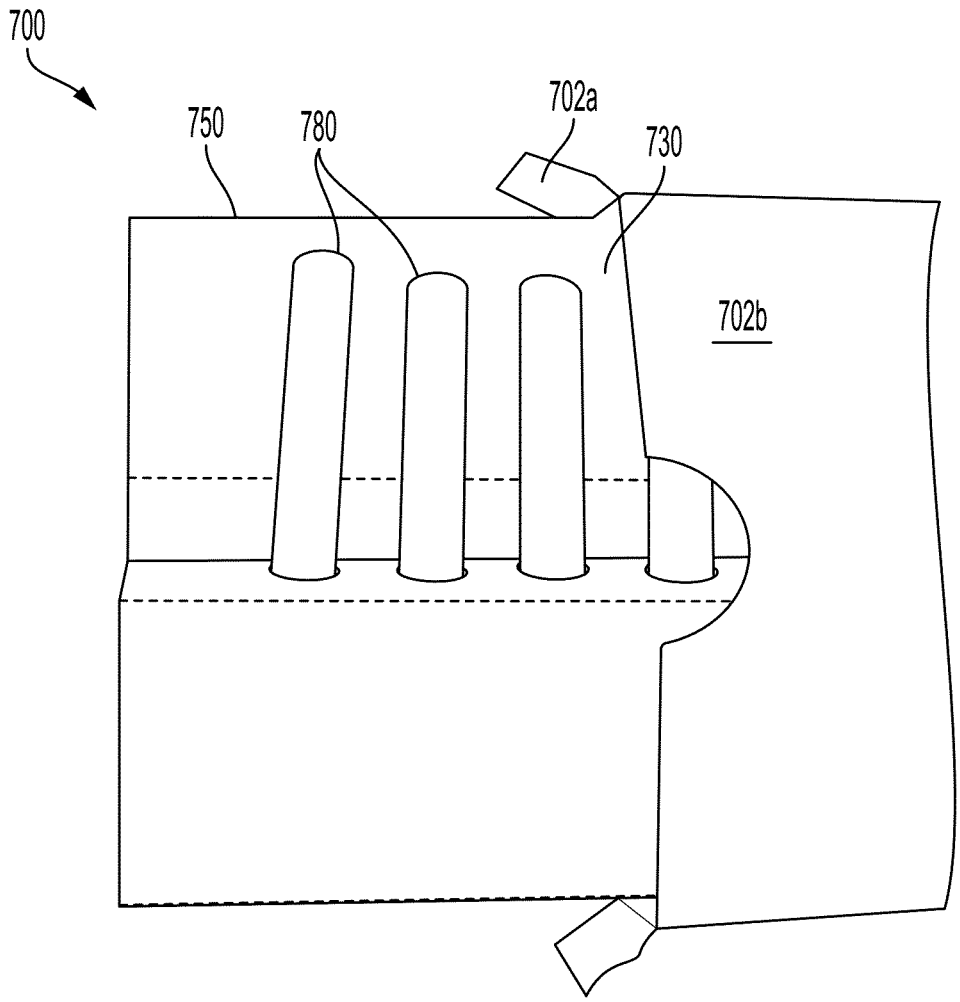
Figure 15B:
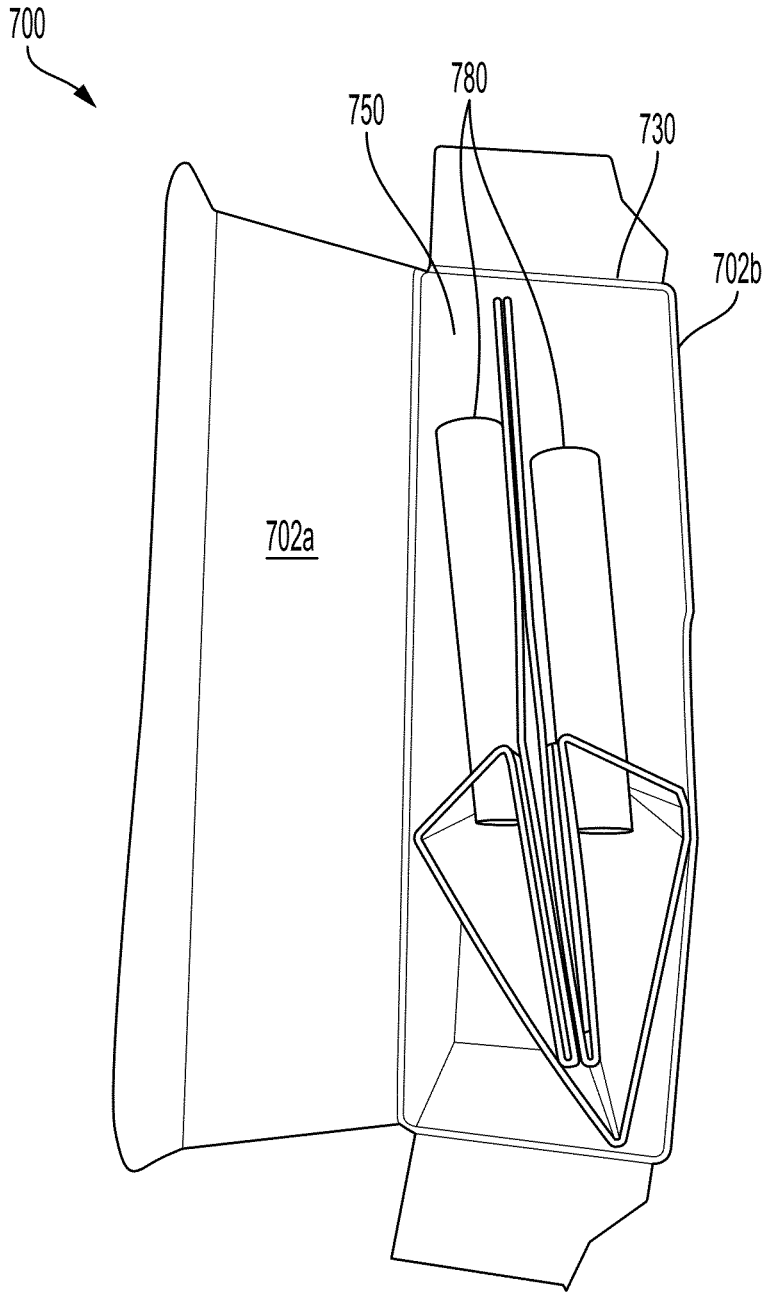
Figure 16A:
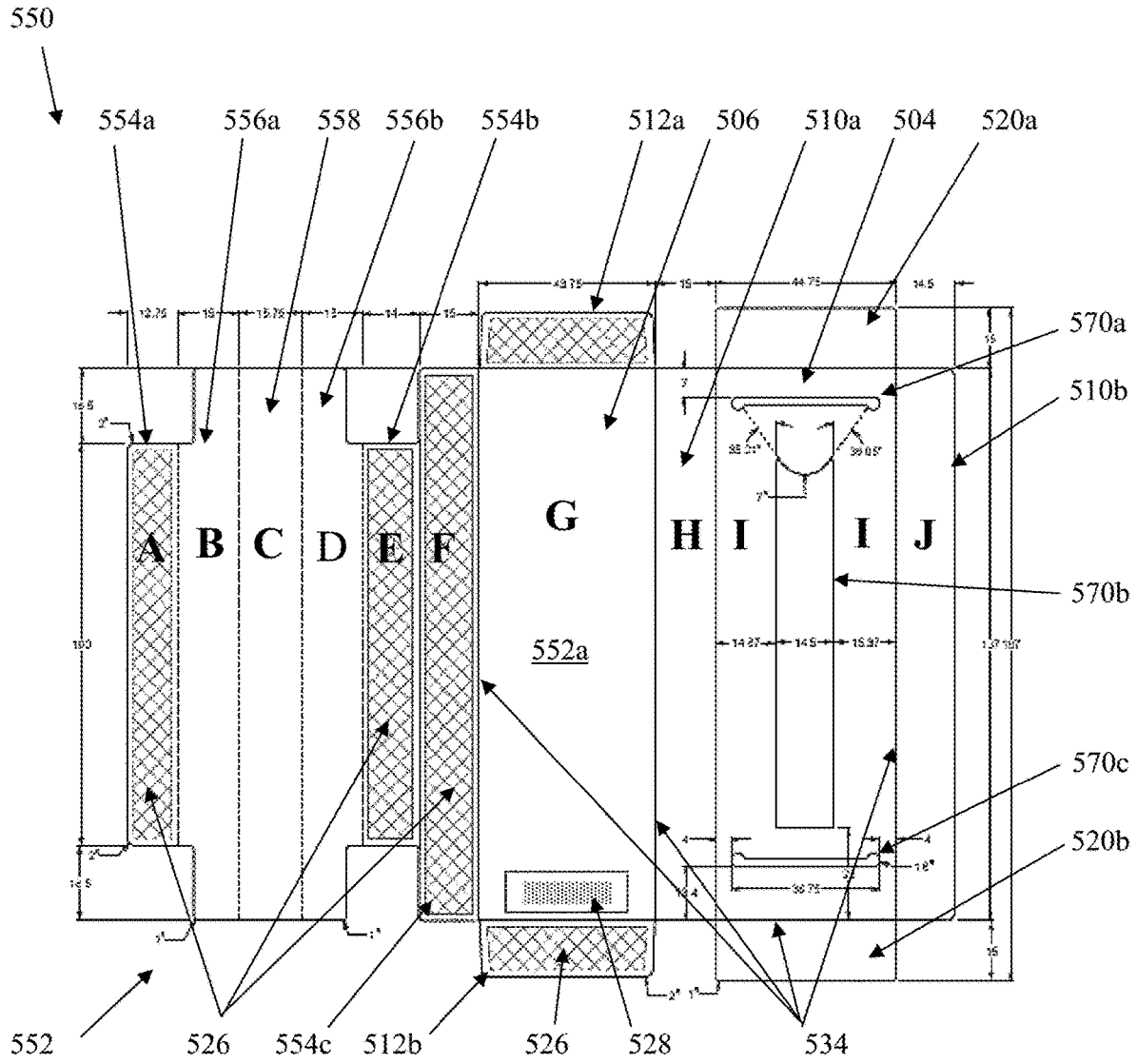
Figure 16B:
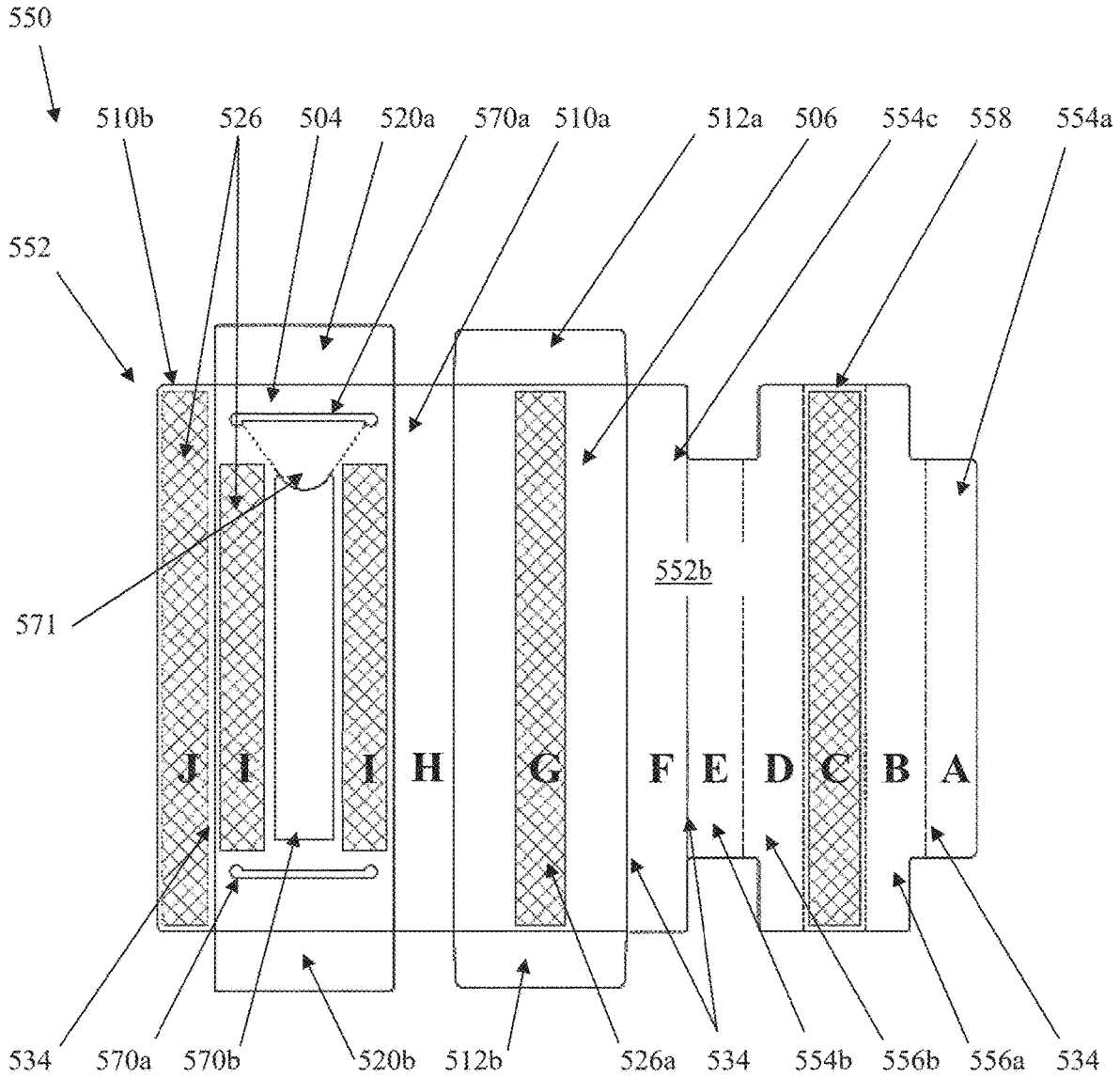
Figure 18A:
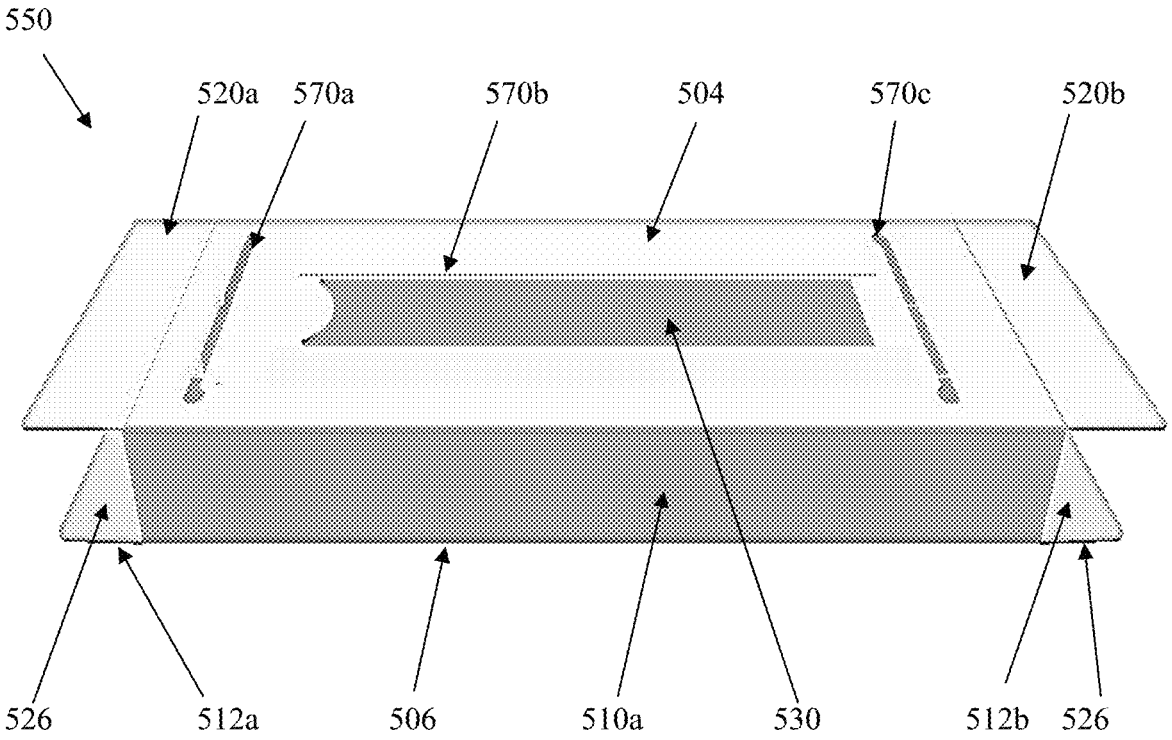
Figure 18B:
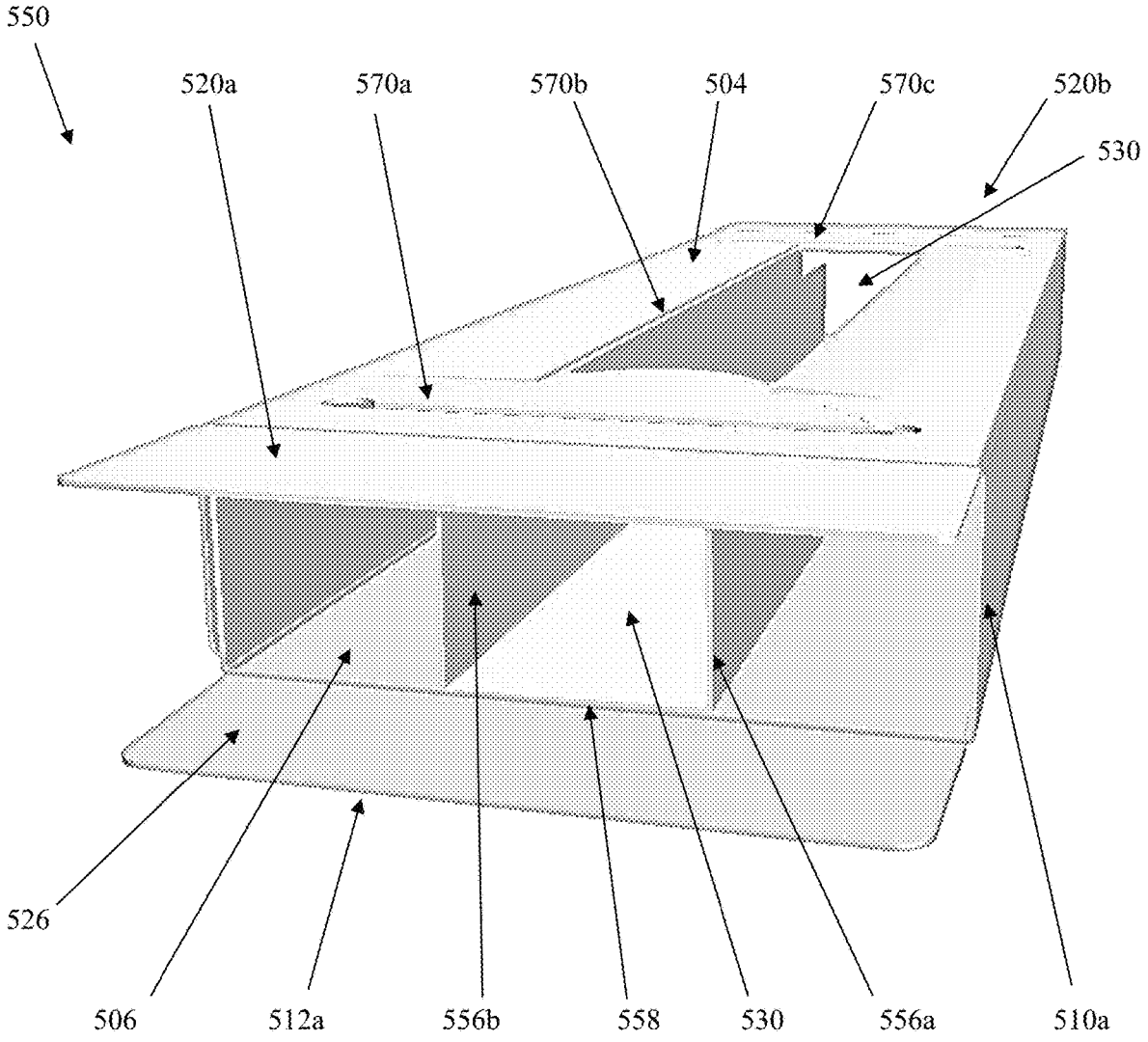
Figure 18C:
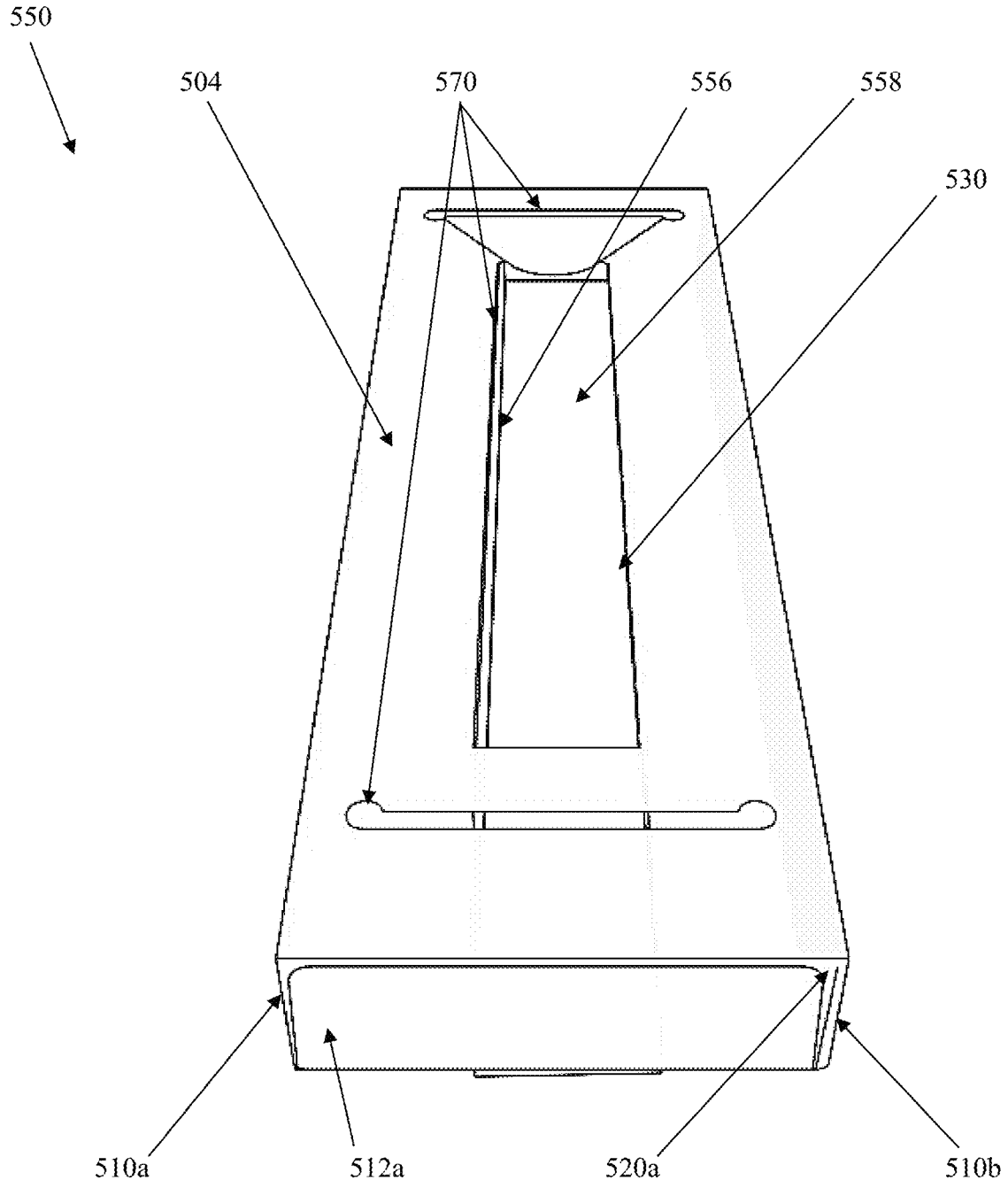
Figure 19:
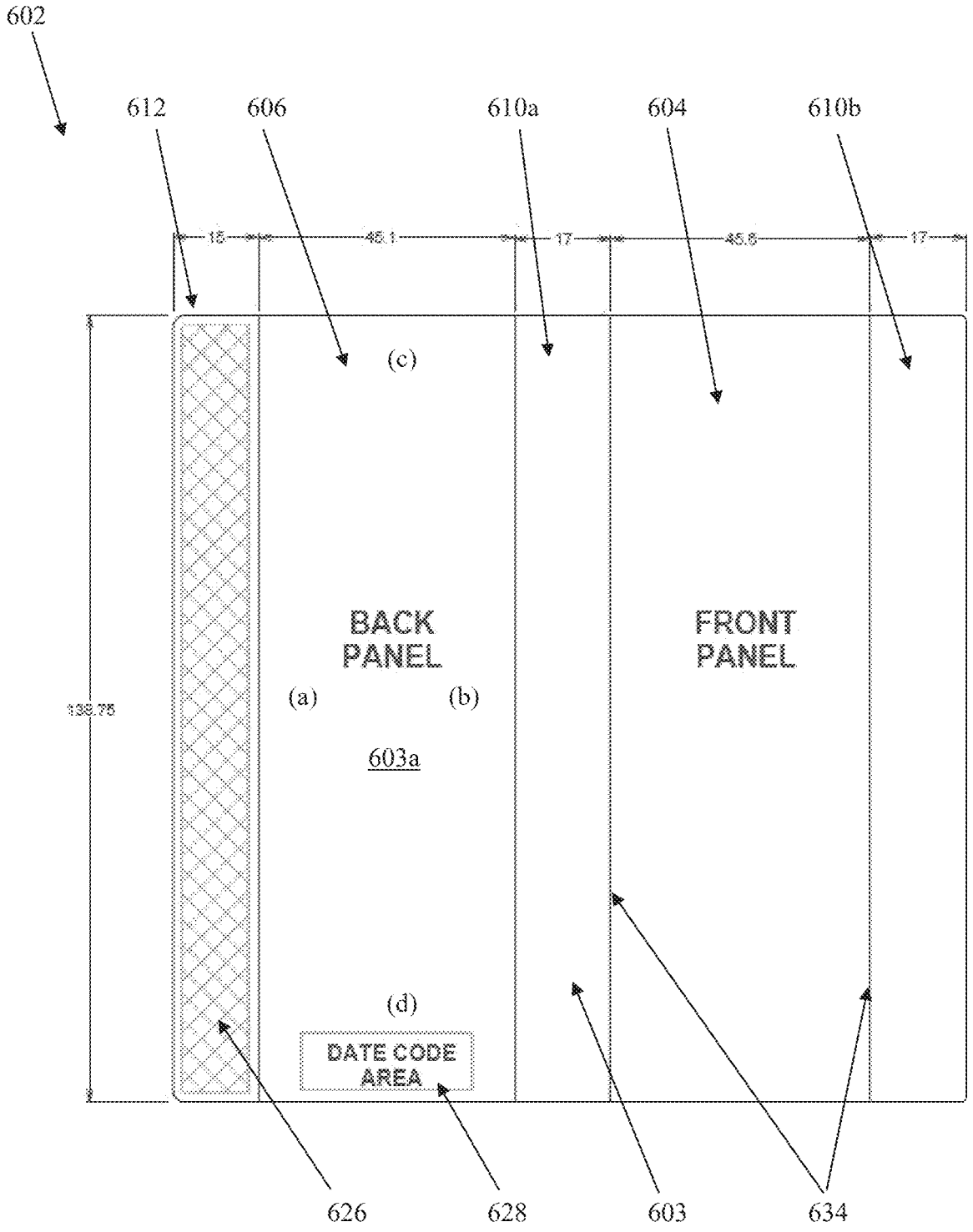

Having thus described aspects of the disclosure in the foregoing general terms, reference will now be made to the accompanying figures, which are not necessarily drawn to scale, and wherein:

FIG. 1 is a pictorial representation of a packaging device in an assembled configuration and including an inlay and a plurality of consumable components, according to some example implementations;

FIG. 2 is a pictorial representation of an alternative packaging device in an assembled configuration and including an inlay and a plurality of consumable components, according to some example implementations;

FIG. 3 is a schematic plan view of a blank configured to form an outer package of the packaging device of FIG. 1, according to some example implementations of the present disclosure;

FIG. 4 is a schematic plan view of a blank configured to form an outer package of the packaging device of FIG. 2, according to some example implementations;

FIG. 5 is a schematic plan view of a blank configured to form the inlay of FIG. 1, according to some example implementations;

FIG. 6 is a schematic plan view of a blank configured to form the inlay of FIG. 2, according to some example implementations;

FIG. 7 is a three-dimensional top/front view of an assembled outer package of FIG. 3 with an assembled inlay of FIG. 5 inserted therein, according to some example implementations;

FIG. 8 is a three-dimensional bottom/front view of the assembled outer package and inlay of FIG. 7, according to some example implementations;

FIG. 9 is a three-dimensional top/end view of the assembled inlay of FIG. 5, according to some example implementations;

FIG. 10 is a three-dimensional wire frame view of the assembled outer package of FIG. 2 with two assembled inlays of FIG. 3 inserted therein, according to some example implementations;

FIGS. 11A-11C are three-dimensional views of the inlay of FIG. 3 in various states of assembly, according to some example implementations;

FIG. 12 is a schematic plan view of an alternative blank configured to form an inlay, according to some example implementations;

FIGS. 13A-13D are pictorial plan views of a first surface of the blank of FIGS. 13A and 13B in a flat configuration and several folded configurations, according to some example implementations;

FIGS. 13E and 13F are pictorial plan views of a second surface of a blank configured to form an inner package in a flat configuration and a partially folded configuration, respectively, according to some example implementations;

FIGS. 14A and 14B are three-dimensional views of the blank of FIG. 12 in various states of assembly, according to some example implementations;

FIGS. 14C and 14D are pictorial side and end views of the blank of FIG. 12 in an assembled configuration, according to some example implementations;

FIGS. 15A and 15B are pictorial views of the assembled inlay of FIG. 12 incorporated within an outer package, according to some example implementations;

FIG. 16A is a schematic plan view of a first surface of a blank configured to form an inner package, according to some example implementations;

FIG. 16B is a schematic plan view of a second surface of the blank of FIG. 16A, according to some example implementations;

FIGS. 17A-17E are pictorial representations of the steps for assembling the packaging blank of FIGS. 16A and 16B and including an outer sleeve, according to some example implementations;

FIGS. 18A-18C are three-dimensional views of the assembled inner package of FIGS. 16A and 16B, according to some example implementations; and FIG. 19 is a schematic plan view of a blank configured to form an outer sleeve for the inner package of FIGS. 16A and 16B, according to some example implementations.

DETAILED DESCRIPTION

Some implementations of the present disclosure will now be described more fully hereinafter with reference to the accompanying figures, in which some, but not all implementations of the disclosure are shown. Indeed, various implementations of the disclosure may be embodied in many different forms and should not be construed as limited to the implementations set forth herein; rather, these example implementations are provided so that this disclosure will be thorough and complete, and will fully convey the scope of the disclosure to those skilled in the art. Like reference numerals refer to like elements throughout.

Unless specified otherwise or clear from context, references to first, second or the like should not be construed to imply a particular order. A feature described as being above another feature (unless specified otherwise or clear from context) may instead be below, and vice versa; and similarly, features described as being to the left of another feature else may instead be to the right, and vice versa. Also, while reference may be made herein to quantitative measures, values, geometric relationships or the like, unless otherwise stated, any one or more if not all of these may be absolute or approximate to account for acceptable variations that may occur, such as those due to engineering tolerances or the like.

As used herein, unless specified otherwise or clear from context, the "or" of a set of operands is the "inclusive or" and thereby true if and only if one or more of the operands is true, as opposed to the "exclusive or" which is false when all of the operands are true. Thus, for example, "[A] or [B]" is true if [A] is true, or if [B] is true, or if both [A] and [B] are true. Further, the articles "a" and "an" mean "one or more," unless specified otherwise or clear from context to be directed to a singular form. Furthermore, it should be understood that unless otherwise specified, the terms "data," "content," "digital content," "information," and similar terms may be at times used interchangeably. Additionally, where multiples of the same components are described, the multiples may be referred to individually (e.g., ##a, ##b, ##c, etc.) or collectively (##).

Example implementations of the present disclosure are generally directed to packaging devices including outer packages and inlays, and the blanks for forming the same. Examples of packages and package blanks are disclosed in U.S. Pat. Nos. 8,549,823 and 9,738,049, and U.S. Patent Publication No. 2015/0321787, the disclosures of which are hereby incorporated by reference herein in their entireties.

FIGS. 1 and 2 are pictorial representations of two different implementations of a packaging device 100, 200 as disclosed herein. As shown in FIG. 1, the device 100 includes an outer package 102 and an inlay 150 disposed therein, where the inlay 150 is configured to hold one or more consumable components 180. The device 100 is shown configured to hold twenty cartridges in a substantially elongated, rectangular-shaped device 100; however, the overall size and shape of the outer package 102 and inlay 150, and the number of components held therein, may vary to suit a particular application. The packaging device 100 has an open configuration (shown) and a closed configuration. The outer package 102 is made up of a plurality of panels that are configurable (e.g., foldable and securable) to define an inner cavity 130 substantially enclosed by the panels in the closed configuration. The outer package 102 includes a reconfigurable portion 102*a* and a base portion 102*b*, where the reconfigurable portion is movable relative to the base portion to provide access to the inner cavity (open configuration) and to engage the base portion in the closed configuration. Various implementations of outer packages are described in greater detail below with respect to FIGS. 3 and 4.

The inlay 150 is made up of a second plurality of panels that are configurable to form an outer shape generally corresponding to the size and shape of the inner cavity 130, so as to fit therein. The inlay 150 may be held within the inner cavity 130 by a frictional fit or an adhesive, either removably so or permanently. At least one of the second plurality of panels defines a plurality of openings or recesses distributed across a surface of the at least one panel that are sized and shaped to removably engage with one or more consumable components. In some implementations, the openings 170 are substantially evenly distributed across the at least one panel. Various implementations of inlays are described in greater detail below with respect to FIGS. 5 and 6.

The alternative packaging device 200 shown in FIG. 2 also includes an outer package 202 and at least one inlay 250 disposed therein, where the inlay 250 is configured to hold one or more consumable components 280. The device 200 is shown configured to hold ten cartridges at one end in a substantially rectangular-shaped device 200; however, the overall size and shape of the outer package 202 and inlay 250, and the number of inlays and components held therein, may vary to suit a particular application. The packaging device 200 has an open configuration (shown) and a closed configuration. The outer package 202 is also made up of a plurality of panels that are configurable (e.g., foldable and securable) to define an inner cavity 230 substantially enclosed by the panels in the closed configuration. The outer package 202 includes a reconfigurable portion 202*a* and a base portion 202*b*, where the reconfigurable portion is movable relative to the base portion to provide access to the inner cavity (open configuration) and to engage the base portion in the closed configuration. Various implementations of outer packages are described in greater detail below with respect to FIGS. 3 and 4.

The inlay 250 is made up of a second plurality of panels that are configurable to form an outer shape generally corresponding to the size and shape of the inner cavity 230, so as to fit therein. The inlay 250 may be held within the inner cavity 130 by a frictional fit or an adhesive, either removably so or permanently. At least one of the second plurality of panels defines a plurality of openings or recesses distributed across a surface of the at least one panel that are sized and shaped to removably engage with one or more consumable components. In some implementations, the openings 270 are substantially evenly distributed across the at least one panel. Various implementations of inlays are described in greater detail below with respect to FIGS. 5 and 6.

FIG. 3 depicts a plan view of a first packaging blank 103 for forming an outer package 102. The blank 103 has a first surface 103*a* as shown and a second opposing surface (103*b* not shown). The blank 103 includes a plurality of panels, such as a front panel 104, a back panel 106, an inside panel 108, and a plurality of intermediate panels 110, end panels 112, and flaps 120. As shown in FIG. 3, the back panel 106 has first and second lateral sides (a), (b) and first and second longitudinal ends (c), (d) defining a generally rectangular shape; however, other shapes are contemplated and considered within the scope of the invention. A first intermediate panel 110*a* extends from the first lateral side (a) of the back panel 106, a second intermediate panel 110*b* extends from the second lateral side (b) of the back panel, a first end panel 112*a* extends from the first longitudinal end (c) of the back panel, and a second end panel 112*b* extends from the second longitudinal end (d) of the back panel 106. Each end panel 112*a*, 112*b* includes an end tab 114*a*, 114*b*, a first side tab 116*a*, 116*b*, and a second side tab 118*a*, 118*b*, each extending from a side of its respective end panel. In various implementations, an adhesive material 126 is disposed on the first surface of the end panels 112*a*, 112*b*, the end tabs 114*a*, 114*b*, and side tabs 116*a*, 116*b*.

The inside panel 108 extends from the first intermediate panel 110*a*. The inside panel 108 has first and second lateral sides, first and second longitudinal ends, a first flap 120*a* extending from the first longitudinal end of the inside panel, and a second flap 120*b* extending from the second longitudinal end of the inside panel 108. Portions of the second surface of the inside panel 108 are configured to engage the first and second end panels 112*a*, 112*b*, the first and second end tabs 114*a*, 114*b*, and the first side tabs 116*a*, 116*b* via the adhesive disposed thereon when the blank 103 is folded or otherwise assembled. A portion of the first intermediate panel 110*a* and the second lateral side of the inside panel 108 may define a receptacle 122, such as, for example, a slot formed in the joint where the first intermediate panel 110*a* and the inside panel 108 are joined. The receptacle 122 may be configured (e.g., sized and shaped) to receive a tab or other closure mechanism to secure the outer package 102 in a closed configuration.

The front panel 104 extends from the second intermediate panel 110*b*. The front panel 104 has first and second lateral sides, first and second longitudinal ends, and a tab 124 extending outwardly from the second lateral side of the front panel 104. The tab 124 is configured (e.g., sized and shaped) to removably engage the receptacle 122 in the closed configuration. In some implementations, the tab 124 may include one or more structures 142 (e.g., protrusions and/or cut-outs) to assist in securing the tab within the receptacle 122.

The various panels described herein are interconnected via boundaries between the panels, which may be defined by a plurality of predetermined fold lines 134, which allow the individual panels to be "hingedly" coupled to one another to allow folding in one or both directions. Some or all of the fold lines 134 (including 234, 534, and 634 in later figures) may be imaginary lines as shown in the figures for illustration purposes only. Alternatively, some or all of the fold lines 134 may be formed in the blank 103 by stamping, indenting or pre-creasing the corresponding sections of the blank. Further still, some or all of the fold lines 134 may be provided with a series of perforations to assist with folding of the blank 103 along the predetermined fold lines. Additionally, some of the panels may include additional structure 140 (e.g., cut-outs, recesses, chamfers, rounded corners, etc.) that assist with the folding the panels relative to one another.

The adhesives 126 used to secure certain panels in overlapping contact may include double sided tape or glue and may be pressure sensitive, heat sensitive, UV cured, or as otherwise known in the industry. Other exemplary types of adhesives that may be used include vinyl acetates, hot melts, and dextrins, such as those available from Henkel AG & Co. Furthermore, any dimensions shown in the figures are in mm and are for exemplary purposes only, and the actual dimensions will vary to suit a particular application, for example, number, size, and types of components to be held within the packaging devices.

The blanks described herein are configured to form a package or an inlay. The blank(s) may comprise various materials, such as, for example, paperboard, paper film laminations (e.g., a metalized film), corrugated board, chipboard, fiberboard, and/or thermoplastic. However, various other materials may be employed in other implementations. In some implementations the material defining the blank may be laminated or coated with wax or other material. Further, the blank may be imprinted via any of various known methods to provide the blank with, for example, an ornamental design, identifying information, or other indicia 128, 228, 628. For example, the first surface 103*a* of the back panel 106 may include printed indicia 128, such as a date code or the like. Useful exemplary materials include paperboard of a suitable type and stock, such as 10 to 14 point SBS paper board (e.g., solid bleached sulfate paper), which may include a coating on one or both sides, such as a clay coating. Comparable board containing post-consumer recycled content likewise may be used. Suitable paper stock can be obtained commercially, such as from International Paper or WestRock.

Generally, the back panel 106, the first intermediate panel 110*a*, the first and second end panels 112*a*, 112*a* (sometimes referred to collectively as 112), and the inside panel 108 are folded relative to one another and secured in their folded configuration via the adhesive 126 to form the base portion 102*b* and define the inner cavity 130. The second intermediate panel 110*b* and the front panel 104 are configured to form the reconfigurable portion 102*a*, so that when in the closed configuration, the second intermediate panel 110*b* is oriented above the inner cavity 130 and the front panel 104 overlaps the inside panel 108, with the tab 124 inserted into the receptacle 122 to secure the reconfigurable portion 102*a* in place (see, e.g., FIGS. 7 and 8). In some implementations, the first intermediate panel 110*a* includes a cut-out 146 disposed adjacent to the receptacle 122 to assist a user with removing the tab 124 therefrom and opening the package 102.

FIG. 4 depicts an alternative packaging blank 203 for forming an outer package 202. The blank 203 has a first surface 203*a* as shown and a second opposing surface (203*b* not shown). The blank 203 includes a plurality of panels, such as a front panel 204, a back panel 206, two side panels 210*a*, 210*b* (sometimes referred to collectively as 110), a plurality of end panels and flaps 220, 224, and an engagement panel 208. As shown in FIG. 4, the back panel 206 has first and second lateral sides (a), (b) and first and second longitudinal ends (c), (d) defining a generally rectangular shape; however, other shapes are contemplated and considered within the scope of the invention.

A first side panel 210*a* extends from the first lateral side of the back panel 206 and includes a first flap 220*a* extending from a first longitudinal end of the first side panel 210*a* and a second flap 220*b* extending from a second longitudinal end of the first side panel 210*a*. An engagement panel 208 extends from the second lateral side of the back panel 206 and includes an adhesive material 226 at least partially disposed on the first surface 203*a* of the engagement panel 208. First and second end panels 224*a*, 224*b* extend from their respective first and second longitudinal ends of the back panel 206. Each end panel 224*a*, 224*b* includes and end flap 225*a*, 225*b* extending from their respective distal ends of the end panels 224*a*, 224*b*. The blank 203 also includes a front panel 204 extending from a first lateral side of the first side panel 210*a* and having first and second lateral sides and first and second longitudinal ends, wherein each of the first and second longitudinal ends define a recess 246 in the front panel 204, and a second side panel 210*b* extending from a first lateral side of the front panel 204 and including first and second flaps 220*c*, 220*d* extending from their respective first and second longitudinal ends of the second side panel 210*b*. The second surface 203*b* of the second side panel 210*b* is configured to overlap and engage with the first surface 203*a* of the engagement panel 208 via the adhesive 226.

Generally, the back panel 206, the first and second side panels 210, the engagement panel 208 and the front panel 204 are folded relative to one another and secured in their folded configuration via the adhesive 226 to form the base portion 202*b* and define an inner cavity 230 running along the entire length of the base portion. The first and second end panels 224 are configured to form two reconfigurable portions 202*a*, one on each end of the outer package 202. In the closed configuration, the first and second end panels 224 are oriented over the openings of the inner cavity 230, with the first and second flaps 225 folded about 90 degrees from their respective end panels 224 and inserted into the base portion 202*b*. The recesses 246 in the front panel 204 can assist a user with removing an end flap 225 from the base portion and opening the package 202.

FIG. 5 depicts a plan view of second packaging blank 152 for forming the inlay 150. The blank 152 has a first surface 152*a* as shown and a second opposing surface (152*b* not shown). The blank 152 includes a plurality of panels. The plurality of panels includes a back panel 162 having first and second lateral sides (a), (b), a first side panel 164*a* extending from the first lateral side of the back panel 162, a top panel 160*a* extending from a lateral side of the first side panel, a second side panel 164*b* extending from a lateral side of the top panel 160*a*, a first intermediate panel 166 extending from the second lateral side of the back panel 162, a bottom panel 160*b* extending from a lateral side of the first intermediate panel 166, and a second intermediate panel 168 extending from a lateral side of the bottom panel 160*b*.

The top and bottom panels 160*a*, 160*b* each include a plurality of openings 170*a*, 170*b* that are substantially evenly distributed across the top and bottom panels 160. The openings 170 are configured to hold one or more components and extend through the panels 160. The first and second intermediate panels 166, 168 include an adhesive 126 disposed on at least a portion of the first surface 152*a* of each panel 166, 168. The first surface 152*a* of the first intermediate panel 166 is configured to engage the second surface 152*b* of the second side panel 164*b* and the first surface 152*a* of the second intermediate panel 168 is configured to engage with the second surface 152*b* of the first side panel 164*a* to form the folded configuration. When the blank 152 is in the folded configuration to form the inlay 150 (see FIG. 9), the top panel 160*a*, bottom panel 160*b*, and the back panel 162 are oriented substantially parallel to one another, and the plurality of openings 170*a* on the top panel 160*a* substantially align with the plurality of openings 170*b* on the bottom panel 160*b*. The inlay 150 is maintained in the folded configuration via the adhesive 126. Each of the top and bottom panels 160 shown have two rows of 10 openings 170 evenly spaced on their respective panels. However, the size, shape, number, and arrangement of openings 170 will vary to suit a particular application.

FIG. 6 depicts an alternative second packaging blank 252 for forming the inlay 250. The blank 252 has a first surface 252*a* as shown and a second opposing surface (252*b* not shown). The blank 252 includes a plurality of panels. The plurality of panels includes a base panel 256 having first and second lateral sides (a), (b) and first and second longitudinal ends (c), (d), a first side panel 254*a* extending from the first lateral side of the base panel 256, a second side panel 254*b* extending from the second lateral side of the base panel 256, and first and second upright panels 258*a*, 258*b* extending from respective first and second longitudinal end of the base panel 256. The plurality of panels further includes a top panel 260*a* extending from a lateral side of the second side panel 254*b*, a first intermediate panel 264 extending from a lateral side of the top panel 260*a*, a back panel 262 extending from a lateral side of the first intermediate panel 264, a second intermediate panel 266 extending from a lateral side of the back panel 262, a bottom panel 260*b* extending from a lateral side of the second intermediate panel 266, and a third intermediate panel 268 extending from a lateral side of the bottom panel 260*b*.

The top and bottom panels 260*a*, 260*b* each include a plurality of openings 270 that are substantially evenly distributed across the top and bottom panels 260. The openings 270 are configured to hold one or more components and extend through the panels 260. When the blank 252 is in the folded configuration to form the inlay 250 (see FIGS. 11A-11C), the top panel 260*a*, the bottom panel 260*b*, and the back panel 262 are oriented substantially parallel to one another, and the plurality of openings 270*a* on the top panel 260*a* substantially align with the plurality of openings 270*b* on the bottom panel 260*b*. Each of the top and bottom panels 260 shown have two rows of five openings 270 evenly spaced on their respective panels. However, the size, shape, number, and arrangement of openings 270 will vary to suit a particular application.

The first, second, and third intermediate panels 264, 266, 268 include an adhesive 226 disposed on at least a portion of the first surface 252*a* of each panel 264, 266, 268. The intermediate panels 264, 266, 268 may dimensionally vary to suit a particular application. For example, the first intermediate panel 264 is wider than the second and third intermediate panels 266, 268 in the implementation shown, so that when the blank 252 is folded, the spacing between the parallel top panel 260*a*, bottom panel 260*b*, and back panel 262 is substantially equal; however, the widths of the intermediate panels may vary to vary the spacing between the panels when assembled.

The first surface 252*a* of the first intermediate panel 264 is configured to engage the second surface 252*b* of the first side panel 254*a* via the adhesive 226, the first surface 252*a* of the second intermediate panel 266 is configured to engage the second surface 252*b* of the second side panel 254*b* via the adhesive 226, and the first surface 252*a* of the third intermediate panel 268 is configured to engage the second surface 252*b* of the first intermediate panel 264 via the adhesive 226 when the second plurality of panels are configured to form the inlay. The inlay 250 is maintained in the folded configuration via the adhesive 226.

The first and second upright panels 258*a*, 258*b* are hingedly coupled to the base panel 256, which allows those panels 258 to move relative to the first and second longitudinal ends of the base panel 256. When the assembled inlay 250 is inserted into outer package 202, the uprights 258*a*, 258*b* are folded upwardly so that the insert slides into the base portion 202*b* up to a depth so that the reconfigurable portion 202*a* can be positioned into the closed configuration. The uprights may also assist a user in removing the inlay 250 from the outer package 202.

FIGS. 7-9 depict an implementation of an assembled packaging device 300 having an outer package 302 and an inlay 350. As shown in FIGS. 7 and 8, the device 300 includes a base portion 302*b* that defines an inner cavity 330 that is configured to receive the inlay 350. As shown, the inlay 350 has a size and shape that corresponds to that of the inner cavity 330 so that the inlay is removably secured therein. The inlay 350 may be held in place by a slight frictional fit or a weak adhesive. In some implementations, a stronger adhesive may be used to maintain the inlay 350 in place.

As shown in FIG. 7, the device 300 is shown with the reconfigurable portion 302*a* (front panel 304 and second intermediate panel 310*b*) in the open configuration (i.e., the tab 324 is removed from the receptacle 322), such that the components (180 in FIG. 1) are accessible to a user. The side tabs 316 are shown folded over the inlay 350; however, they can be raised to fully expose the inner cavity 330 and folded back down to transition the package to the closed configuration. The openings 370 are sized and shaped to hold the components in a desirable orientation with minimal frictional engagement so that a user may relatively easily remove a component from the inlay 350.

FIG. 8 depicts the device 300 in the closed configuration, where the reconfigurable portion 302*a* is positioned such that the second intermediate panel covers the inner cavity 330 and the front panel 304 overlaps the inside panel 308, with the tab 324 engaging with the receptacle so as to secure the device 300 in the closed configuration. As can be seen in FIG. 8, the inlay 350 rests on the interior bottom surface (first intermediate panel 310*a*) of the outer package 302 so that there is a certain amount of free space above the inlay 350 to accommodate the components.

A perspective view of the assembled inlay 350 is shown in FIG. 9. As shown, the top panel 360*a*, the bottom panel 360*b*, and the back panel 362 are oriented horizontally and substantially parallel after the blank is folded. Similarly, side and intermediate panels 364, 366, 368 are oriented vertically and substantially parallel to one another. In addition, the first plurality of openings 370*a* are aligned with the second plurality of openings 370*b*.

FIGS. 10 and 11A-11C depict an alternative implementation of an assembled packaging device 400 having an outer package 402 and two inlays 450*a*, 450*b*. As shown in FIG. 10, the outer package 402 includes a base portion 402*b* that defines an inner cavity 430 that is configured to receive the inlays 450. The inner cavity 430 may be accessed via openings at each end of the outer package 402. As shown, the inlays 450 have a cross-sectional size and shape that corresponds to a cross-sectional size and shape of the inner cavity 430 so that the inlays 450 are removable secured therein. The inlays 450 may be held in place by a slight frictional fit or a weak adhesive. In some implementations, a stronger adhesive may be used to maintain the inlays 450 in place.

As shown in FIG. 10, the device 400 is shown with two reconfigurable portions 402*a* (end panels 424*a*, 424*b* and end flaps 425*a*, 425*b*) in the open configuration, i.e., the tab 425 flap is removed from the inner cavity 430 and the end panels 424 are no longer positioned over the inner cavity openings, such that the components (280 in FIG. 2) are accessible to a user. As also shown, the inlays 450 are inserted so that the components held thereby may be accessed from either side of the packaging device 400. Specifically, the inlays 450 are positioned within the base portion 402*a* in a back-to-back orientation, where the base panels 456 are positioned adjacent or in contact with each other. An adhesive may also be disposed on one or both base panels 456 to secure the inlays relative to one another. As shown, the upright panels 458 (FIG. 11A) assist in correctly positioning the inlays 450 when their ends are generally flush with their respective openings and providing a certain amount of free space above the inlay to accommodate the components. In some implementations, the uprights 458 may be used to assist a user in removing the inlay 450 from the base portion 402*b*. The outer package 402 can be transitioned to the closed configuration be folding the end panels 424 over the inner cavity openings and inserting the end flaps 425 into the inner cavity 430.

The assembled inlays 450 are shown in greater detail in FIGS. 11A-11C. Specifically, FIG. 11A provides an end view of a single assembled inlay 450 with the upright panels 458 unfolded and illustrating the relative positioning of the top and bottom panels 460*a*, 460*b*, the back panel 462, the side panels 454*a*, 454*b*, the intermediate panels 464, 466, 468, and the pluralities of openings 470*a*, 470*b*. As shown, panels 460, 462 are in a generally parallel and horizontal orientation, while panels 454, 464, 466, 468 are in a generally parallel and vertical orientation; however, the relative orientation/positioning of the panels may vary to suit a particular, application. For example, in some implementations the top and/or bottom panel 460 may be angled relative to the back and/or base panel 462, 456 so as to present the components to the user in a different or better orientation for access and/or for aesthetic purposes. As also shown in FIG. 11A, the first plurality of openings 470*a* are substantially aligned with the second plurality of openings 470*b* so the components may be held, for example, in a substantially vertical orientation by both panels 460 with an end of the component resting on the back panel 462.

FIG. 11B depicts the single inlay 450 with the upright panels 458*a*, 458*b* configured upwardly for insertion into the inner cavity (430 in FIG. 10). In this configuration, the inlay 450 is completely enclosed except for the openings 470 for the components. FIG. 11C depicts the two inlays 450*a*, 450*b* configured as they would be when inserted into the outer package 402. As shown, the back panels 456, 456' are positioned back-to-back and in contact with one another. In some implementations, the inlays 450 are maintained in contact via an adhesive. In this configuration, the top panels 460*a*, 460*a'*, along with the component openings 470, 470', face away from one another so that a user may remove a component from either end of the outer package 402.

FIG. 12 depicts another alternative second packaging blank 752 for forming an inlay 750. The blank 752 has a first surface 752*a* as shown and a second opposing surface 752*b* (see FIGS. 13E and 13F). The blank 752 includes a plurality of panels interconnected via a series of fold lines 734. The plurality of panels includes first and second base panels 762*a*, 762*b* having first and second lateral sides (a), (b) and first and second longitudinal ends (c), (d), where the first lateral side (a) of the second base panel 762*b* is hingedly coupled to the second lateral side (b) of the first base panel 762*a*; and a first top panel 760*a* extending from the first lateral side (a) of the first base panel 762*a* and a first inner side panel 764*a* extending from a lateral side of the first top panel 760*a*, where the first top panel 760*a* and the first inner side panel 764*a* define a first plurality of openings 770*a* substantially evenly distributed across the first top and first inner side panels and configured to hold one or more components (see 780 in FIGS. 14A and 14B). The plurality of panels further includes a second top panel 760*b* extending from the second lateral side (b) of the second base panel 762*b* and a second inner side panel 764*b* extending from a lateral side of the second top panel 760*b*, where the second top panel and the second inner side panel define a second plurality of openings 770*b* substantially evenly distributed across the second top and second inner side panels and configured to hold one or more components; a first outer side panel 768*a* extending from a lateral side of the first inner side panel 764*a*; a second outer side panel 768*b* extending from a lateral side of the second inner side panel 764*b*; first and second intermediate panels 766*a*, 766*b* extending from a lateral side of their respective first and second outer side panels 768*a*, 768*b*; and first and second extension panels 758*a*, 758*b* extending from a lateral side of their respective first and second intermediate panels 766*a*, 766*b*. The openings 770 are shown having generally oblong or elongated shapes; however, the exact shape and size of the openings 770 can vary to suit a particular application. For example, the oblong shape may reduce material and ease the insertion and removal of the consumable relative to the openings 770.

In some implementations, the blank 752 includes an adhesive 726 disposed on the first surface 752*a* of certain panels (e.g., first and second inner side walls 764 and/or first and second outer side walls 768) and/or the second surface 752*b* of certain panels (e.g., first and second extension panels 758) to facilitate the assembly of the blank 752 into the inlay 750.

When the second blank 752 is in a folded configuration, the first surface of the first outer side panel 768*a* engages the first surface of the first inner side panel 764*a* via the adhesive 726 or others means as disclosed herein, the first surface of the second outer side panel 768*b* engages the first surface of the second inner side panel 764*b* via the adhesive 726, the second surface of the first extension panel 758*a* engages the second surface of the second extension panel 758*b* via the adhesive 726, and the second surface of the first base panel 762*a* is oriented towards the second surface of the second base panel 762*b* so as to nest the engaged first inner and outer side panels and the engaged second inner and outer side panels therebetween and orient at least a portion of the first and second plurality of openings 770 to receive the one or more components.

FIGS. 13A-13F depict the process of assembling (i.e., folding) the blank 752 into the inlay 750. In some implementations, the order of folding or otherwise positioning the various panels is preferably done in a particular order for simplicity. FIGS. 13A-13D depict the first surface 752*a* of the blank, where FIG. 13A depicts the blank 752 in an unfolded configuration and FIG. 13B depicts the blank 752 after the first surface of the first outer side panel (3) 768*a* is folded towards and engages with the first surface of the first inner side panel (4) 764*a* and the first surface of the second outer side panel (10) 768*b* is folded towards and engages with the first surface of the first inner side panel (9) 764*b*. The panels may be secured in their engaged orientations via the adhesive or other means as disclosed herein. FIGS. 13E and 13F provide the opposite view of FIGS. 13A and 13B. Specifically, FIGS. 13E and 13F depict the second surface 752*b* of the blank 752, where FIG. 13E depicts the blank 752 in an unfolded configuration and FIG. 13F depicts the blank 752 after the first surface of the first outer side panel (3) 768*a* is folded towards and engages with the first surface of the first inner side panel (4) 764*a* and the first surface of the second outer side panel (10) 768*b* is folded towards and engages with the first side of the first inner side panel (9) 764*b*.

FIGS. 13C and 13D depict the first and second sides, respectively, of the blank 752 after the second surface of the first base panel 762*a* is oriented towards the second surface of the second base panel 762*b* by folding the blank 752 (see also FIG. 14B). In this orientation, the second surfaces of the first and second extension panels 758*a*, 758*b* are engaged and secured to one another, with the inlay 750 is in an essentially fully collapsed orientation.

FIGS. 14A-14D depict the inlay 750 in its assembled configuration. FIG. 14A depicts the inlay 750 after inner and outer side walls 764, 768 have been engaged, but before the base panels 762 have been folded. FIG. 14B depicts the inlay 750 after the base panels 762 have been folded and the extension panels 758 secured to one another. This may be considered a neutral orientation. As can be seen, after the inner and outer walls 764, 768 have been engaged, a triangular-shaped receptacle 772 is formed that is configured for receiving the components (780 in FIGS. 14C and 14D). Further, the top panels 760 are oriented proximate to one another and separated by the extension panels 758. As shown in FIG. 14D, which is an end view of the assembled inlay 750 with the components 780 inserted therein, the intermediate panels 766 are able to flex relative to the extension panels 758 and the receptacles 772 and provide clearance between the components 780 and the extension panels 758, for example, to separate the consumables from the inlay and the other row of consumables. In addition, the inlay 750 in an "unflexed" orientation assumes a smaller or narrower profile, allowing the inlay 750 to be inserted into a narrower outer package for improved portability (see, e.g., FIG. 15B). The size and shape of the panels may vary to suit a particular application; for example, increasing or decreasing the dimensions of panels 766*a*, 766*b* to increase or decrease the amount of clearance. FIG. 14C is a side view of the assembled inlay 750 with the components 780 inserted therein. As shown, ten components 780 are held on each side of the inlay 750; however, the overall length of the inlay 750, and the number and spacing of the components 780, may vary to suit a particular application.

FIGS. 15A and 15B depict one implementation of a packaging device 700 including an outer package 702 and the inlay 750 described above. The packaging device 700 has an open configuration (shown) and a closed configuration. The outer package 702 is also made up of a plurality of panels that are configurable (e.g., foldable and securable) to define an inner cavity 730 substantially enclosed by the panels in the closed configuration. The outer package 702 includes a reconfigurable portion 702*a* and a base portion 702*b*, where the reconfigurable portion is movable relative to the base portion to provide access to the inner cavity (open configuration) and to engage the base portion in the closed configuration. The outer package 702 may be structurally similar to the outer package 202 of FIG. 4, but with dimensions chosen to suit the different inlay 750.

FIG. 15A depicts a side view of the packaging device 700 with the inlay 750 slightly advanced out of the outer package 702. The inlay 750 is slidable relative to the outer package 702, specifically within the inner cavity 730, such that the inlay can be pulled out of the outer package 702 as necessary for a user to access the components 780 and then slid back into the cavity 730 (i.e., fully inserted therein). FIG. 15B depicts an end view of the packaging device 700 in the open configuration with the inlay 750 fully inserted within the inner cavity 730. As can be seen in FIG. 15B, the inlay 750 may be partially collapsed via the flexible panels in order to fit within the inner cavity 730.

FIGS. 16A and 16B depict a packaging blank 552 for a packaging device 550 configurable between a planar configuration and a folded configuration to define a receptacle 570 for retaining a component. The blank 552 is an inner package blank having a first surface 552*a* (FIG. 16A) and a second opposing surface 552*b* (FIG. 16B). The blank 552 includes a plurality of panels, such as, a first engagement panel (A) 554*a* having first and second lateral sides and an adhesive 526 deposited over at least a portion of the first surface 552*a* of the first engagement panel 554*a*; a first inner side panel (B) 556*a* extending from the second lateral side of the first engagement panel (A) 554*a* and having first and second lateral sides; and a support panel (C) 558 extending from the second lateral side of the first inner side panel (B) 556*a* and having first and second lateral sides and the adhesive 526 deposited over at least a portion of the second surface 552*b* of the support panel 558. Generally, the adhesive 526 is deposited as a strip corresponding to a length and/or width of the particular panel and may also be sized and oriented to correspond to the panel or surface to which it is configured to engage. See, for example, FIG. 16B.

The inner package blank 552 further includes a second inner side panel (D) 556*b* having first and second lateral sides and extending from the second lateral side of the support panel (C) 558; a second engagement panel (E) 554*b* having first and second lateral sides and extending from the second lateral side of the second inner side panel (D) 556*b* and having the adhesive 526 deposited over at least a portion of the first surface 552*a* of the second engagement panel 554*b*; a third engagement panel (F) 554*c* having first and second lateral sides and extending from the second lateral side of the second engagement panel (E) 554*b* and having the adhesive deposited over at least a portion of the first surface 552*a* of the third engagement panel 554*c*; and a back panel (G) 506 having first and second lateral sides, first and second longitudinal ends, and first and second end flaps 512*a*, 512*b* extending from the first and second longitudinal ends. The back panel (G) 506 extends from the second lateral side of the third engagement panel (F) 554*c* and has the adhesive 526 deposited over at least a portion of the first surface 552*a* of the first and second end flaps 512, and in some cases also a portion of the second surface 552*b* of the back panel 506. The blank 552 further including a first outer side panel (H) 510*a* having first and second lateral sides and extending from the second lateral side of the back panel (G) 506; a front panel (I) 504 having first and second lateral sides, first and second longitudinal ends, and first and second end flaps 520*a*, 520*b* extending from the first and second longitudinal ends, with the panel (I) 504 extending from the second lateral side of the first outer side panel (H) 510*a* and defining a plurality openings 570 configured to hold the component and having adhesive 526 deposited over at least a portion of the second surface 552*b* of the front panel 504; and a second outer side panel (J) 510*b* having first and second lateral sides and extending from the second lateral side of the front panel (I) 504 and having the adhesive 526 deposited over at least a portion of the second surface 552*b* of the second outer side panel 510*b*. As shown, the plurality of openings 570 in the front panel 504 includes two narrow slits 570*a*, 570*c* disposed proximate their respective longitudinal ends and a larger, centrally located opening 570*b*. The larger opening 570*b* is configured to hold a component, such as, for example, an aerosol delivery device, while the smaller openings 570*a*, 570*c* are configured to hold an insert or pamphlet (e.g., user instructions). The size, shape, quantity, and placement of the openings 570 will vary to suit a particular application.

In various implementations, the panels may have differing lengths so as to accommodate certain features or uses for the inner package. For example, in some implementations, the receptacle 570*b* for holding the device includes a tear-away portion 571 to assist in removing the device. If the engagement panels 554*a*, 554*b* were longer the adhesive may bond to the tear-away portion 571 rendering it ineffective. Additionally, where receptacles 570*a*, 570*c* are configured to have an insert or pamphlet slid therein, inner side panels 556*a*, 556*b* are preferably notched or slightly shorter to allow the insert to pass through the entire width of the receptacles 570*a*, 570*c*.

Figure 17A:
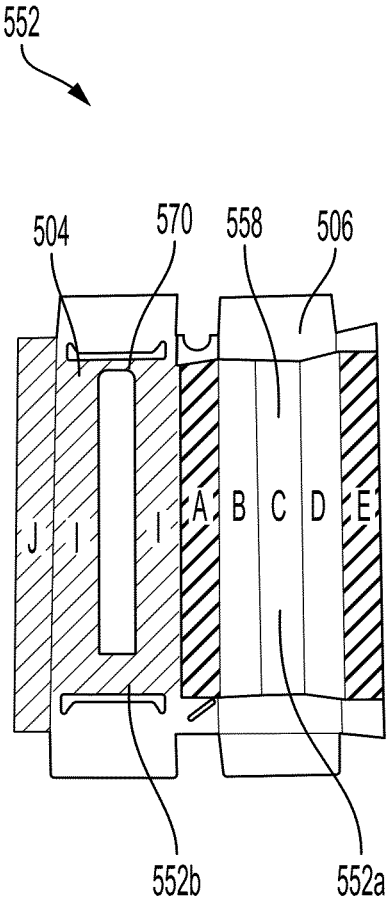
Figure 17B:
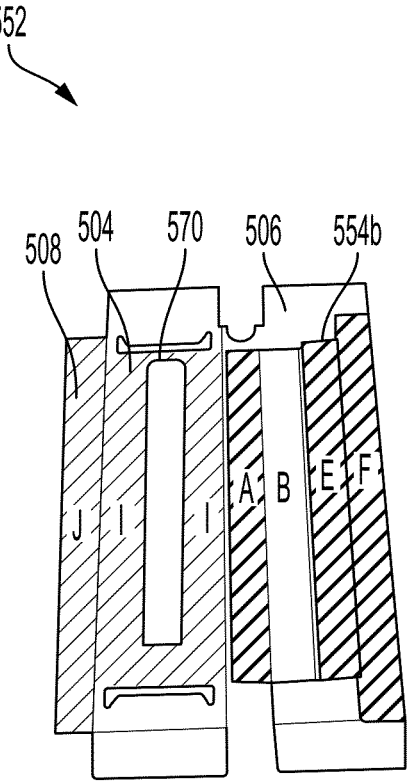
Figure 17C:
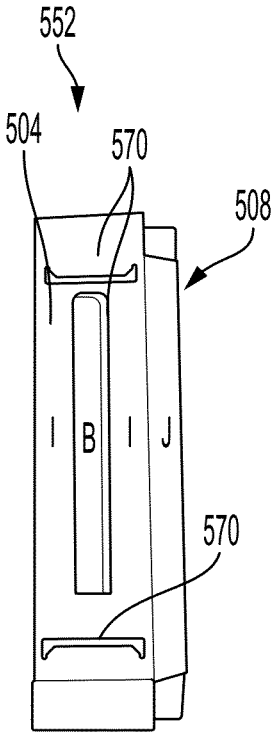
Figure 17D:
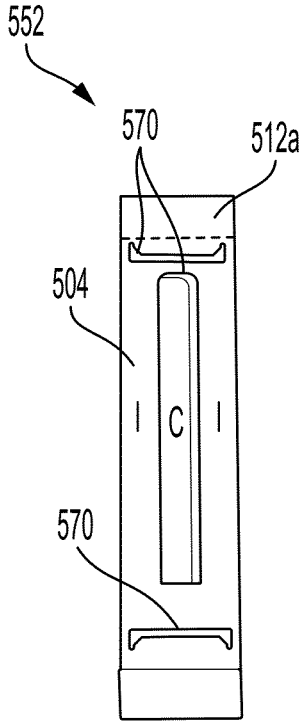
Figure 17E:
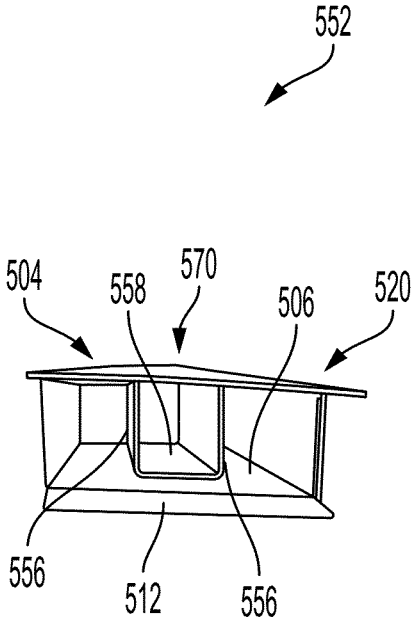

In some implementations, the order of folding or otherwise positioning the various panels is preferably done in a particular order for simplicity. For example, when the inner package blank 552 is transitioned into the folded configuration (see FIGS. 17A-17E), the second surface 552 of the support panel (C) 558 first engages the second surface of the back panel (G) 506 via the adhesive (FIG. 17A), and then the first engagement panel (A) 554*a* and the second engagement panel (E) 554*b* are folded inwardly, which positions the first inner side panel (B) 556*a* and the second inner side panel (D) 556*b* substantially perpendicular to the back panel (G) 506 (FIG. 17B). Next, the first surface 552*a* of the first engagement panel (A) 554*a* engages the first surface 552*a* of the first outer side panel (H) 510*a* via the adhesive (FIG. 17C), and then the second surface 552*b* of the front panel (I) 504 engages the first surfaces of the first and second engagement panels (A), (E) 554 via the adhesive (FIG. 17C). The second surface 552*b* of the second outer side panel (J) 510*b* then engages with the first surface 552*a* of the third engagement panel (F) 554*c* (FIG. 17C). Generally, FIG. 17C depicts the side panels 510 assembled, but the inner package 550 in a flat configuration, as may be used for storing and shipping the inner package(s) 550, while FIGS. 17D and 17E depict front and end views of the inner package 550 in the folded configuration and clearly defining the receptacle openings 570. Finally, the second surfaces 552*b* of the first and second end flaps 520 of the front panel (I) 504 engage the first surfaces of the respective first and second end flaps 512 of the back panel (G) 506 (see, for example, FIG. 18C).

FIGS. 18A-18C provide three-dimensional views of the assembled blank, i.e., inner package 550. FIG. 18A depicts a side view of a first lateral side of the package 550 with the end flaps 520, 512 open. In one implementation, the bottom end flaps 512*a*, 512*b* have an adhesive 526 deposited thereon for engaging the second surfaces of the front panel end flaps 520*a*, 520*b* so as to enclose the inner cavity 530. In some implementations, the adhesive is also deposited on a portion of the second surfaces 552*b* of the front panel end flaps 520. As shown, the receptacle 570 extends through the front panel 504 and is in communication with an inner cavity 530 defined by the walls of the package 550.

FIG. 18B depicts an end view, also with the flaps 512, 520 open, that more clearly illustrates the inner cavity 530 that is defined by the support panel 558, the two inner side panels 556, and the front panel 504. The inner cavity 530 has a generally rectangular shape centrally located in the inner package 550; however, the shape, size, and position of the inner cavity 530 may vary to suit a particular application. FIG. 18C depicts a perspective end view of the fully assembled inlay 550, with the front panel end flaps 520 folded over the open ends and the back panel end flaps 512 folded over and adhered to the front panel end flaps 520.

FIG. 19 depicts one implementation of an outer sleeve 602 that is configured to slidably engage with and about the inner package 550. The outer sleeve is also made of a blank 603 having a first surface 603*a* as shown and a second surface (603*b* not shown). The blank 603 includes a back panel 606 having first and second lateral sides (a), (b) and first and second longitudinal ends (c), (d); a first engagement panel 612 extending from the first lateral side of the back panel 606 and having an adhesive disposed on at least a portion of the first surface 603*a* thereof; a first side panel 610*a* extending from the second lateral side of the back panel 606; a front panel 604 extending from a lateral side of the first side panel 610*a*; and a second side panel 610*b* extending from a lateral side of the front panel 604. The sleeve 602 is assembled by folding the various panels so that the second surface 603*b* of the second side panel 610*b* engages the first surface 603*a* of the engagement panel 612 via the adhesive, such that the front and back panels 604, 606 are substantially parallel. Generally, the first surface 603*a* of the blank defines the outer surface of the sleeve 602, while the second surface 603*b* defines the inner surface of the sleeve 602.

The present disclosure is also directed to methods of forming the above-described packaging devices. In one implementation, the method includes providing a first blank comprising a first plurality of panels, configuring the first blank so that the first plurality of panels forms a base portion defining an inner cavity and a reconfigurable portion moveable relative to the base portion to have an open configuration and a closed configuration, providing a second blank comprising a second plurality of panels, and configuring the second blank to form an inlay having an external shape corresponding to an internal shape of the inner cavity and having at least one panel with a plurality of openings substantially evenly distributed across the at least one panel and configured to hold one or more components. The method may further include positioning the inlay into the inner cavity of the base portion so that the one or more components is accessible to a user in the open configuration and the reconfigurable portion engages the base portion in the closed configuration to enclose the components. Positioning the inlay into the inner cavity of the base portion comprises removably securing the inlay within the inner cavity via, for example, an adhesive or a friction fit. The method may further include printing indicia, such as an ornamental design, identifying information, or a date code on at least one of the panels.

In various implementations, the different blanks may comprise a variety of materials to suit a particular application, such as those described with respect to FIG. 3, and each blank may be imprinted via any of various known methods to provide the blank with, for example, an ornamental design, and/or identifying information or other indicia 128, 228, 628.

Generally, when the blanks are assembled into their finished configurations, the assembly may involve folding the blanks. Unless otherwise noted, each of the folds employed in forming the blanks into their finished configurations involves moving a first surface of the referenced panels toward one another or may involve moving the second surface of the referenced panels toward one another. Folds that are conducted in a differing direction from other folds are referenced as being "opposing."

Furthermore, the blanks should be understood as a substantially two-dimensional structures configured to be manipulated into a three-dimensional package. The blanks may comprise one or more layers of one or more materials suitable to provide structure to the blank such that it may form a package as described herein. The blanks may define various sizes and shapes and, accordingly, it should be understood that the illustrated blanks are provided for example purposes only.

Having described in the individual panels of the blanks in the illustrated implementations, it should be appreciated that additional panels may be added to the blanks without deviating from the scope of this disclosure. However, it should also be appreciated that in some implementations, advantages may stem from the blanks exclusively defined by surface defined by the set of illustrated panels without more.

Although directional terms such as top, bottom, front, back, etc. have been employed herein, it should be understood that these terms have been provided for explanatory purposes only. In this regard, the blanks and packages disclosed herein may be employed in other configurations and orientations beyond those described above.

In various implementations, the present disclosure may also be directed to kits that provide packaging, carrying, or storage components that may be configured or otherwise assembled to accommodate one or more components. For example, in some implementations a kit may comprise a packaging device, and a plurality of components (e.g., a plurality of consumable components). In another implementation, a kit may comprise a packaging device, one or more aerosol delivery devices (or aerosol delivery device control bodies), and a plurality of components (e.g., a plurality of consumable components). In another implementation, a kit may comprise a plurality of packaging devices, each packaging device being associated with a plurality of components (e.g., a plurality of consumable components). In another implementation, a kit may comprise a packaging device, and a plurality of aerosol delivery devices (or aerosol delivery device control bodies). In another implementation, a kit may comprise a plurality of packaging device, each packaging device being associated with a plurality of aerosol delivery devices (or aerosol delivery device control bodies).

Many modifications and other implementations of the disclosure will come to mind to one skilled in the art to which this disclosure pertains having the benefit of the teachings presented in the foregoing descriptions and the associated figures. Therefore, it is to be understood that the disclosure is not to be limited to the specific implementations disclosed herein and that modifications and other implementations are intended to be included within the scope of the appended claims. Although specific terms are employed herein, they are used in a generic and descriptive sense only and not for purposes of limitation.

What is claimed is:

1. A packaging device configurable between a planar configuration and a folded configuration to define a receptacle for retaining a component, the device comprising:

an inner package blank having a first surface and a second surface, the inner package blank comprising:

a first engagement panel (A) comprising first and second lateral sides, wherein an adhesive is deposited over at least a portion of the first surface of the first engagement panel;

a first inner side panel (B) comprising first and second lateral sides and extending from the second lateral side of the first engagement panel (A);

a support panel (C) comprising first and second lateral sides extending from the second lateral side of the first inner side panel (B), wherein the adhesive is deposited over at least a portion of the second surface of the support panel;

a second inner side panel (D) comprising first and second lateral sides and extending from the second lateral side of the support panel (C);

a second engagement panel (E) comprising first and second lateral sides and extending from the second lateral side of the second inner side panel (D), wherein the adhesive is deposited over at least a portion of the first surface of the second engagement panel;

a third engagement panel (F) comprising first and second lateral sides and extending from the second lateral side of the second engagement panel (E), wherein the adhesive is deposited over at least a portion of the first surface of the third engagement panel;

a back panel (G) comprising first and second lateral sides, first and second longitudinal ends, and first and second end flaps extending from the first and second longitudinal ends, the panel (G) extending from the second lateral side of the third engagement panel (F), wherein the adhesive is deposited over at least a portion of the first surface of the first and second end flaps;

a first outer side panel (H) comprising first and second lateral sides and extending from the second lateral side of the back panel (G);

a front panel (I) comprising first and second lateral sides, first and second longitudinal ends, and first and second end flaps extending from the first and second longitudinal ends, the panel (I) extending from the second lateral side of the first outer side panel (H), wherein the front panel defines at least one opening configured to form the receptacle configured to hold the component, and the adhesive is deposited over at least a portion of the second surface of the front panel; and a second outer side panel (J) comprising first and second lateral sides and extending from the second lateral side of the front panel (I), wherein the adhesive is deposited over at least a portion of the second surface of the second outer side panel;

wherein, when the packaging device is in the folded configuration, the second surface of the support panel (C) engages the second surface of the back panel (G) via the adhesive; first engagement panel (A) and the second engagement panel (E) are folded inwardly to orient the first inner side panel (B) and the second inner side panel (D) substantially perpendicular to the back panel (G); the second surface of the front panel (I) engages the first surfaces of the first and second engagement panels (A), (E) via the adhesive; the second surface of the second outer side panel (J) engages the first surface of the third engagement panel (F); and the second surfaces of the first and second end flaps of the front panel (I) engage the first surfaces of the respective first and second end flaps of the back panel (G).

2. The packaging device of claim 1 further comprising an outer sleeve configured to slidably engage with an outer surface of the folded inner package blank, the outer sleeve comprising:

a sleeve blank having a first surface and a second surface, the blank comprising:

a back panel comprising first and second lateral sides and first and second longitudinal ends;

a first engagement panel extending from the first lateral side of the back panel, wherein the adhesive is disposed on at least a portion of the first surface thereof;

a first side panel extending from the second lateral side of the back panel;

a front panel extending from a lateral side of the first side panel; and a second side panel extending from a lateral side of the front panel, wherein the second surface of the second side panel at least partially overlaps and engages the first surface of the engagement panel via the adhesive, such that the front and back panels are substantially parallel.

3. The packaging device of claim 1, wherein the panels are hingedly coupled to one another via fold lines created by stamping, indenting, pre-creasing, a series of perforations, or any combination thereof.

4. The packaging device of claim 1, wherein the front panel defines a plurality of openings.

5. The packaging device of claim 4, wherein the plurality of openings comprises two narrow slits disposed proximate their respective longitudinal ends and a larger, centrally located opening.

6. The packaging device of claim 1, wherein the front panel further comprises a tear-away portion.

7. The packaging device of claim 2, wherein any one of the blanks comprise paperboard, corrugated board, chipboard, fiberboard, thermoplastic, paper film laminations, or combinations thereof.

8. The packaging device of claim 2, wherein any one of the blanks comprise indicia comprising one or more of an ornamental design, identifying information, or a date code.

9. The packaging device of claim 2, wherein the inner package blank in a folded configuration is secured within the folded sleeve blank via at least one of an adhesive or a friction fit.

10. A packaging device configurable between a planar configuration and a folded configuration to define a receptacle for retaining a component, the device comprising:

an inner package blank having a first surface and a second surface, the inner package blank comprising:

a first engagement panel (A) comprising first and second lateral sides, wherein an adhesive is deposited over at least a portion of the first surface of the first engagement panel;

a first inner side panel (B) comprising first and second lateral sides and extending from the second lateral side of the first engagement panel (A);

a support panel (C) comprising first and second lateral sides extending from the second lateral side of the first inner side panel (B), wherein the adhesive is deposited over at least a portion of the second surface of the support panel;

a second inner side panel (D) comprising first and second lateral sides and extending from the second lateral side of the support panel (C);

a second engagement panel (E) comprising first and second lateral sides and extending from the second lateral side of the second inner side panel (D), wherein the adhesive is deposited over at least a portion of the first surface of the second engagement panel;

a third engagement panel (F) comprising first and second lateral sides and extending from the second lateral side of the second engagement panel (E), wherein the adhesive is deposited over at least a portion of the first surface of the third engagement panel;

a back panel (G) comprising first and second lateral sides, first and second longitudinal ends, and first and second end flaps extending from the first and second longitudinal ends, the panel (G) extending from the second lateral side of the third engagement panel (F), wherein the adhesive is deposited over at least a portion of the first surface of the first and second end flaps;

a first outer side panel (H) comprising first and second lateral sides and extending from the second lateral side of the back panel (G);

a front panel (I) comprising first and second lateral sides, first and second longitudinal ends, and first and second end flaps extending from the first and second longitudinal ends, the panel (I) extending from the second lateral side of the first outer side panel (H), wherein the front panel defines a plurality of openings configured to hold the component, the plurality of openings comprising a first narrow slit disposed proximate the first longitudinal end of the front panel, a second narrow slit disposed proximate the second longitudinal end, and a larger, centrally located opening extending along a length of the front panel; and a second outer side panel (J) comprising first and second lateral sides and extending from the second lateral side of the front panel (I), wherein the adhesive is deposited over at least a portion of the second surface of the second outer side panel;

wherein, when the packaging device is in the folded configuration, the second surface of the support panel (C) engages the second surface of the back panel (G) via the adhesive; first engagement panel (A) and the second engagement panel (E) are folded inwardly to orient the first inner side panel (B) and the second inner side panel (D) substantially perpendicular to the back panel (G); the second surface of the front panel (I) engages the first surfaces of the first and second engagement panels (A), (E) via the adhesive; the second surface of the second outer side panel (J) engages the first surface of the third engagement panel (F); and the second surfaces of the first and second end flaps of the front panel (I) engage the first surfaces of the respective first and second end flaps of the back panel (G).

11. The packaging device of claim 10, wherein in the folded configuration the packaging device defines an inner cavity that is only accessible via the plurality of openings in the front panel (I).

12. The packaging device of claim 10, wherein in the folded configuration, the second surfaces of the first and second end flaps of the front panel (I) engage the first surfaces of the respective first and second end flaps of the back panel (G) via the adhesive to secure the packaging device against opening.

13. The packaging device of claim 10 further comprising an outer sleeve configured to slidably engage with an outer surface of the folded inner package blank, the outer sleeve comprising:

a sleeve blank having a first surface and a second surface, the blank comprising:

a back panel comprising first and second lateral sides and first and second longitudinal ends;

a first engagement panel extending from the first lateral side of the back panel, wherein the adhesive is disposed on at least a portion of the first surface thereof;

a first side panel extending from the second lateral side of the back panel;

a front panel extending from a lateral side of the first side panel; and a second side panel extending from a lateral side of the front panel, wherein the second surface of the second side panel at least partially overlaps and engages the first surface of the engagement panel via the adhesive, such that the front and back panels are substantially parallel.

14. The packaging device of claim 10, wherein the panels are hingedly coupled to one another via fold lines created by stamping, indenting, pre-creasing, a series of perforations, or any combination thereof.

* * * * *